US008504135B2

(12) United States Patent
Bourqui et al.

(10) Patent No.: US 8,504,135 B2
(45) Date of Patent: Aug. 6, 2013

(54) TRAVELING-WAVE ANTENNA

(75) Inventors: Jeremie Bourqui, Calgary (CA); Elise C. Fear, Calgary (CA); Michal Okoniewski, Calgary (CA)

(73) Assignee: UTI Limited Partnership, Calgary, Alberta (CA)

( * ) Notice: Subject to any disclaimer, the term of this patent is extended or adjusted under 35 U.S.C. 154(b) by 609 days.

(21) Appl. No.: 12/606,853

(22) Filed: Oct. 27, 2009

(65) Prior Publication Data

US 2010/0145190 A1 Jun. 10, 2010

Related U.S. Application Data

(60) Provisional application No. 61/197,560, filed on Oct. 27, 2008.

(51) Int. Cl.
*H01Q 13/00* (2006.01)

(52) U.S. Cl.
USPC ..... 600/407; 343/785

(58) Field of Classification Search
USPC ..... 600/407, 425, 430; 343/767
See application file for complete search history.

(56) References Cited

U.S. PATENT DOCUMENTS

| | | | | |
|---|---|---|---|---|
| 5,949,382 | A | 9/1999 | Quan | 343/767 |
| 6,208,308 | B1 | 3/2001 | Lemons | 343/785 |
| 6,351,246 | B1 | 2/2002 | McCorkle | 343/795 |
| 6,911,951 | B2 | 6/2005 | Dotto et al. | 343/767 |
| 7,088,300 | B2 | 8/2006 | Fisher | 343/767 |
| 7,193,575 | B2 | 3/2007 | Mohammadian | 343/767 |
| 7,454,242 | B2 | 11/2008 | Fear et al. | 600/430 |
| 2005/0107693 | A1* | 5/2005 | Fear et al. | 600/430 |
| 2005/0219126 | A1* | 10/2005 | Rebeiz et al. | 343/700 MS |

OTHER PUBLICATIONS

Bourqui et al., "Balanced antipodal vivaldi antenna for breast cancer detection," *2nd Eur. Conf Antennas Propag.*, Edinburgh, UK, Nov. 11-16, 2007.

Bourqui et al., "Balanced antipodal vivaldi antenna with dielectric director for near-field microwave imaging," to appear in *IEEE Trans. Antennas Propag.*, 52 (7): 2010.

Bourqui et al., "Antenna performance for ultra-wideband microwave imaging," in *IEEE Radio and Wireless Symposium*, San Diego, CA, pp. 522-525, Jan. 18-22, 2009.

Bourqui, "Director effect on the radiation behaviour of the BAVA_ ID4," *Interrnal Technical Report*, University of Calgary, 2007.

Craddock et al., "An improved hemispherical antenna array design for breast imaging," in *EurAAP—The Second European Conference on Antennas and Propagation, Edinburgh, UK*, Nov. 11-16, 2007.

(Continued)

*Primary Examiner* — Parikha Mehta
(74) *Attorney, Agent, or Firm* — Fogarty, L.L.C.

(57) ABSTRACT

Embodiments of endfire aperture-based traveling-wave antennas are described. For example, an embodiment, including a Vivaldi antenna, may have a director incorporated into the aperture region of the antenna to provide enhanced radiation directivity. The director may be a shaped dielectric that interacts with an electromagnetic field to reduce the divergence of the resultant beam as it exits the antenna. Additional dielectric substrate layers may be stacked on both sides of the antenna in order to balance the dielectric loading between the different conductors. The dielectric substrates may also eliminate contact between the antenna metallization and the lossy environment. Certain disclosed Vivaldi antennas may be used in tissue screening applications.

21 Claims, 32 Drawing Sheets

OTHER PUBLICATIONS

Elsherbini et al., "Uwb antipodal vivaldi antennas with protruded dielectric rods for higher gain, symmetric patterns and minimal phase center variations," in *Proc. IEEE Antennas and Propagation Society International Symposium*, 1973-1976, 2007.
Fear et al., "Confocal microwave imaging for breast cancer detection: localization of tumors in three dimensions," *IEEE Transactions on Biomedical Engineering*, 49 (8): 812-822, 2002.
Gibbens et al., "The design of a wide slot antenna for the transmission of UWB signals into the human body using FDTD simulation," *2nd European Conference on Antennas and Propagation, Edinburgh*, UK, 1: 1-5, Nov. 11-16, 2007.
Guillanton et al., "A new design tapered slot antenna for ultra-wideband applications," *Microwave and optical Technology Letters*, 19 (4): 286-289, 1998.
Khor et al., "An ultra wideband microwave imaging system for breast cancer detection," *IEICE Trans. Commun.*, E90-B (9): 2376-2381, 2007.
Kim and Chang, "Ultra wideband exponentially-tapered antipodal vivaldi antennas," *IEEE Antennas Propag. Soc. Int. Symp.*, 3: 2004.
Langley et al., "Balanced antipodal vivaldi antenna for wide bandwidth phased arrays," *IEE Proceedings—Microwaves, Antennas and Propagation*, 143 (2): 97-102, 1996.
Langley et al., "Multi-octave phased array for circuit integration using balanced antipodal vivaldi antenna elements," *IEEE Antennas Propag. Soc. Int. Symp.*, 1: 178-181, 1995.
Langley et al., "Novel ultrawide-bandwidth vivaldi antenna with low crosspolarisation," *Electronic Letters*, 29 (23): 2004-2005, 1993.
Lazebnik et al., "A large-scale study of the ultrawideband microwave dielectric properties of normal breast tissue obtained from reduction surgeries," *Physics in Medicine and Biology*, 52 (10): 2637-2656, 2007.
Lazebnik et al., "Highly accurate debye models for normal and malignant breast tissue dielectric properties at microwave frequencies," *IEEE Microwave and Wireless Components Letters*, 17 (12): 822-824, 2007.
Li et al., "Numerical and experimental investigation of an ultrawideband ridged pyramidal horn antenna with curved launching plane for pulse radiation," *IEEE Antennas and Wireless Propagation Letters*, 2: 259-262, 2003.
Montoya et al., "A study of pulse radiation from several broad-band loaded monopoles," *IEEE Transactions on Antennas and Propagation*, 44 (8): 1172-1182, 1996.
Nilavalan et al., "Wideband microstrip patch antenna design for breast cancer tumour detection," *IET Microwave, Attennas & Propagation*, 1: 277-281, 2007.
Rubaek et al., "Three-dimensional microwave imaging for breast-cancer detection using the log-phase formulation," *Proc. IEEE Antennas and Propagation Society International Symposium*, 2184-2187, 2007.
Schuneman et al., "Decade bandwidth tapered notch antenna array element," in *Antenna Applications Symposium*, 280-294, 2001.
Sill and Fear, "Tissue sensing adaptive radar for breast cancer detection: study of immersion liquids," *Electronic Letters*, 41: 113-115, 2005.
Sill and Fear, "Tissue sensing adaptive radar for breast cancer detection—experimental investigation of simple tumor models," *IEEE Transactions on Microwave Theory and Techniques*, 53 (11): 3312-3319, 2005.
Sill, "Second generation experimental system for tissue sensing adaptive radar," Master's thesis, Department of Electrical and Computer Engineering, Schulich School of Engineering, University of Calgary, Alberta, Canada, 2005.
Wang et al., "Analysis of ultra wideband antipodal vivaldi antenna design," *Loughborough Antennas and Propagation Conference*, 129-132, Apr. 2-3, 2007.
Winters et al., "Estimation of the frequency-dependent average dielectric properties of breast tissue using a time-domain inverse scattering technique," *IEEE Transactions on Antennas and Propagation*, 54 (11): 3517-3528, 2006.

* cited by examiner (a)
Energy Flux Density (x,y,z) in dB (b)
Energy Flux Density (x,y,z) in dB (a)

Energy Flux Density (x,y,z) in dB (b)

HEB (x,y,z) in dB (a)

(b)

(a)

(b)

(a)

(b)

(a)

(b)

(a)
Energy Flux Density (x,y,z) in dB (b)
Energy Flux Density (x,y,z) in dB

TATF for different immersion liquid conductivities

TATF for different immersion liquid relative permittivity

TRAVELING-WAVE ANTENNA

CROSS-REFERENCE TO RELATED APPLICATIONS

This application claims the benefit of U.S. Provisional Patent Application No. 61/197,560 filed on Oct. 27, 2008, the entire contents of which is specifically incorporated herein by reference without disclaimer.

TECHNICAL FIELD

This disclosure relates to traveling wave antennas and, more specifically, traveling wave antennas having enhanced directivity.

BACKGROUND OF THE INVENTION

Generally, antennas can be configured to transmit and/or receive energy in the form of electromagnetic waves. In many cases, antennas are coupled with one or more electrical device components and can be configured to transmit and receive signals over a distance, e.g., to relay information. In some cases, antennas are carefully engineered so that signal communication between the antenna and the other device components proceeds with minimal loss in signal integrity, e.g., fidelity. For example, medical imaging devices, such as magnetic resonance imaging machines or microwave imaging systems, can transmit energy and receive corresponding signals through use of specialized antennas. In such applications, signal fidelity can be an important aspect of device operation.

SUMMARY OF THE INVENTION

In general, this document describes endfire aperture-based traveling wave antennas, such as Vivaldi antennas. In some embodiments of the Vivaldi antenna, a director is incorporated into the aperture region of the antenna to provide enhanced radiation directivity. In various embodiments, the director can be a shaped dielectric that interacts with an electromagnetic field to reduce the divergence of the resultant beam as it exits the antenna. In some embodiments of a Vivaldi antenna, additional substrate layers are stacked on both sides of the antenna in order to balance the dielectric loading between the different conductors. The substrates may also eliminate contact between the antenna metallization and the lossy environment.

In a first aspect, an endfire aperture-based traveling wave antenna includes a plurality of conductors separated by a dielectric material and coupled to the antenna feed structure to cooperatively transmit and receive electromagnetic radiation, the plurality of conductors including at least a first flared conductor that flares outwardly from a longitudinal axis and a second flared conductor that flares outwardly from the longitudinal axis in an orientation opposite from the first flared conductor so as to at least partially define an aperture region therebetween. The antenna further includes a director arranged in the aperture region between the first flared conductor and the second flared conductor to provide a concentrated radiation pattern when transmitting the electromagnetic radiation. The director includes a material having a dielectric permittivity higher than the dielectric material that separates the conductors.

Implementations can include any, all, or none of the following features and configurations. The first flared conductor and the second flared conductor can be at least partially defined by an aperture curve and a flare curve. The first and second conductors can curve outwardly, away from the longitudinal axis so as to exhibit separation variations along a length of the first and second conductors. The plurality of conductors can include a third flared conductor that curves outwardly from the longitudinal axis in an orientation opposite the first flared conductor. The first flared conductor can include a central conductor and the second and third conductors can include ground conductors. The first conductor can be separated from the second conductor by a first substrate layer of dielectric material and the first conductor is separated from the third conductor by a second substrate layer of dielectric material. The director can be shaped to substantially conform to a surface of an object for illumination.

In a second aspect, an endfire aperture-based traveling wave antenna includes ground and conductor electrodes each having a flared contour and configured to cooperatively emit radiation in a selected propagation direction, the ground and conductor electrodes being separated by one or more dielectric substrates. A director is configured to at least partially focus the radiation in the selected propagation direction and is arranged at least partially between said ground and conductor electrodes.

Implementations can include any, all, or none of the following features and configurations. The endfire aperture-based traveling wave antenna may be a Vivaldi antenna or an antipodal Vivaldi antenna. The antipodal Vivaldi antenna can be a balanced antipodal Vivaldi antenna. The radiation can be broadband radiation. The broadband radiation can be within a frequency range of about 2 to 18 GHz. The dielectric permittivities of the director can be higher than the dielectric substrate. The configuration to focus or direct said radiation in said selected propagation direction can include the director having dielectric permittivities and a shape that affects propagation of an electromagnetic pulse or wave traveling along the ground and conductor electrodes in a determinable manner. The antenna is immersible in an immersion medium, and in one embodiment, the immersion medium is oil, such as canola oil. In another embodiment, the antenna is immersible in glycerin.

In a third aspect, a method for detecting objects beneath or disposed in biological tissue includes providing the Vivaldi antenna described above and configured for use in a tissue sensing adaptive radar (TSAR) system, and using the TSAR system to detect an object beneath or disposed in said biological tissue.

Implementations can include any, all, or none of the following features and configurations. The Vivaldi antenna can be contacted to a breast.

In a fourth aspect, an antenna includes a plurality of planar ground conductors each having a feeding line ground plane, a planar conductor electrode having a signal conductor on a feeding line, a connector for connecting the ground conductors and the conductor electrode to an external assembly capable of transmitting or receiving electromagnetic energy; and a director, disposed in an area between where a first ground conductor and a first conductor electrode curve away from one another. The planar ground conductors and the planar conductor electrode are separated by one or more dielectric substrates, each dielectric substrate having a dielectric permittivity. The director is formed of a material having a dielectric permittivity higher than that of the one or more dielectric substrates.

In a fifth aspect, a balanced antipodal Vivaldi antenna includes a plurality of ground and conductor electrodes each having a flared contour and configured to cooperatively emit radiation in a selected propagation direction. The ground and conductor electrodes are separated by one or more dielectric substrates having a first dielectric permittivity. Two of the ground conductor electrodes are external layers of the balanced antipodal Vivaldi antenna. The balanced antipodal Vivaldi antenna further includes one or more additional dielectric substrates having a second dielectric permittivity and stacked with the external layers, wherein the one or more additional dielectric substrates are configured to balance a dielectric loading between one or more central conductors and the external layers.

In certain embodiments, the balanced antipodal Vivaldi antenna described above can further include a dielectric coating applied to metallic parts of the antenna that come into contact with a surrounding environment. The dielectric coating can be applied and configured to attenuate electromagnetic losses introduced by a lossy environment.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the present disclosure, suitable methods and materials are described below. In addition, the materials, methods, and examples are illustrative only and not intended to be limiting. All publications, patent applications, patents, and other references mentioned herein are incorporated by reference in their entirety. In case of conflict, the present specification, including definitions, will control.

The term "coupled" is defined as connected, although not necessarily directly, and not necessarily mechanically.

The terms "a" and "an" are defined as one or more unless this disclosure explicitly requires otherwise.

The term "substantially" and its variations are defined as being largely but not necessarily wholly what is specified as understood by one of ordinary skill in the art, and in one non-limiting embodiment "substantially" refers to ranges within 10%, preferably within 5%, more preferably within 1%, and most preferably within 0.5% of what is specified.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements possesses those one or more steps or elements, but is not limited to possessing only those one or more elements. Likewise, a step of a method or an element of a device that "comprises," "has," "includes" or "contains" one or more features possesses those one or more features, but is not limited to possessing only those one or more features. Furthermore, a device or structure that is configured in a certain way is configured in at least that way, but may also be configured in ways that are not listed.

The details of one or more embodiments are set forth in the accompanying drawings and the description below. Other features, objects, and advantages will be apparent from the drawings and detailed description, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

In one general aspect, a balanced antipodal Vivaldi antenna (BAVA) is provided. A BAVA can, in some embodiments, include three conductors separated by dielectric layers, the configuration of which will be known to those skilled in the art of balanced antipodal antenna design and function. In certain implementations of a BAVA, the BAVA includes a director, a shaped dielectric located in the antenna aperture that can provide enhanced radiation directivity in the near field, by providing a more directional or concentrated radiation pattern than a BAVA without a director. In certain implementations of a BAVA, the BAVA includes stacking substrates in order to balance the dielectric loading or reduce contact with lossy media in which the antenna may operate.

Figure 1:
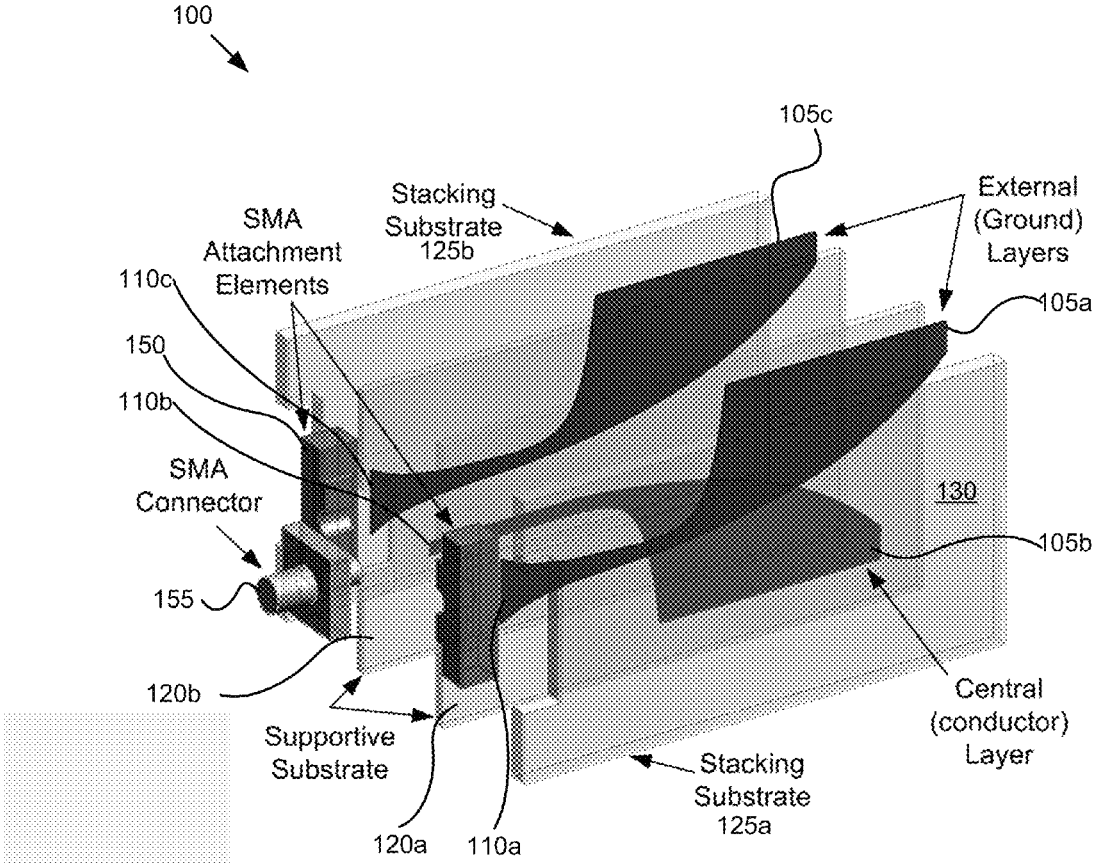
FIG. 1 is an illustration of a Balanced Antipodal Vivaldi Antenna (BAVA), according to one embodiment.

Referring now to FIG. 1, one embodiment of a BAVA includes three copper conductors 105*a-c*; two of the conductors 105*a* and 105*c* are connected to feeding line ground planes 110*a* and 110*c*; the central conductor 105*b* is connected to the signal conductor of the feeding line 110*b*. The copper conductors 105*a-c* are separated by dielectric substrates 120*a-b*. Dielectric layers 125*a-b* (stacking substrates) are positioned on the sides of the conductors 105*a* and 105*c* opposite the dielectric substrates 120*a* and 120*b*. Thus, an exemplary stacking structure of a BAVA 100 includes (e.g., from top to bottom) a first stacking substrate 125*a*, a first conductor 105*a*, a first dielectric substrate 120*a*, a second conductor (e.g., the central conductor 105*b*), a second dielectric substrate 120*b*, a third conductor 105*c*, and a second stacking substrate 125*b*. In one embodiment, the dielectric substrate 120*a-b* may be air.

The antenna feed structure 110 can be a gradual transition between a stripline to a tri-strip transmission line (TL), although other configurations are contemplated. The conductor layer width increases linearly while the widths of the ground conductors decrease exponentially to keep constant impedance along the transition. The tri-strip TL extends for a short distance and then the ground and conductor layers start to flare in opposite directions with exponential curvatures to create an antenna aperture, generally indicated at 130.

Still referring to FIG. 1, in general, the assembled BAVA 100 can be configured so that the ground layers are in electrical communication with parts of a connector such as SMA attachment elements 150. An SMA connector 155 is in electrical communication with the SMA attachments 150 and the feeding line 110*b*. The SMA connector 155 is configured to provide an SMA connection (not shown in FIG. 1) so that electrical signals can be transmitted to and from the BAVA to external components. Contact between the ground layers and the SMA attachment elements 150 can be made by applying pressure thereto using, e.g., two screws (not shown in FIG. 1). The contact between the SMA connector 155 and the feeding line 110*b* is also achieved when pressure is applied, e.g., with the two screws. Other attachments may be used in place of the SMA connector.

In general, one or more layers of supportive substrate (e.g., substrate 120*a-b*) can be disposed adjacent to, and in-between the conductor layer 105*b* and ground layers 105*a*, 105*c*. Substrates 120*a-b* can be formed from materials providing select electrical characteristics that can optimize the function of the BAVA; some of those characteristics are described herein. In one embodiment, the substrates can be formed of materials with permittivity similar to the surrounding environment and very low conductivity. This eliminates contact between the antenna conductors and a lossy medium in which the antenna operates. The substrate 120*a-b* may have one or more recesses on a surface of the substrate 120*a-b*. This can allow one or more of the ground layers 105*a*, 105*c* or the conductor layer 105*b* to lay flush within the recess, which may provide advantages for assembly and function.

In general, one or more of the stacking substrates 125*a-b* can conjoin one or both of the external ground layers (105*a* or 105*c*). The material properties of the one or more stacking substrates 125*a-b* are described herein. Generally, the material can be chosen to be the same as the supportive substrate layers in order to balance the dielectric loading between the central conductor and the external ground plates. It can also be chosen to effect a desired electromagnetic interaction between the ground layers and the environment such as reducing the loss induced by a lossy environment.

Figure 2:
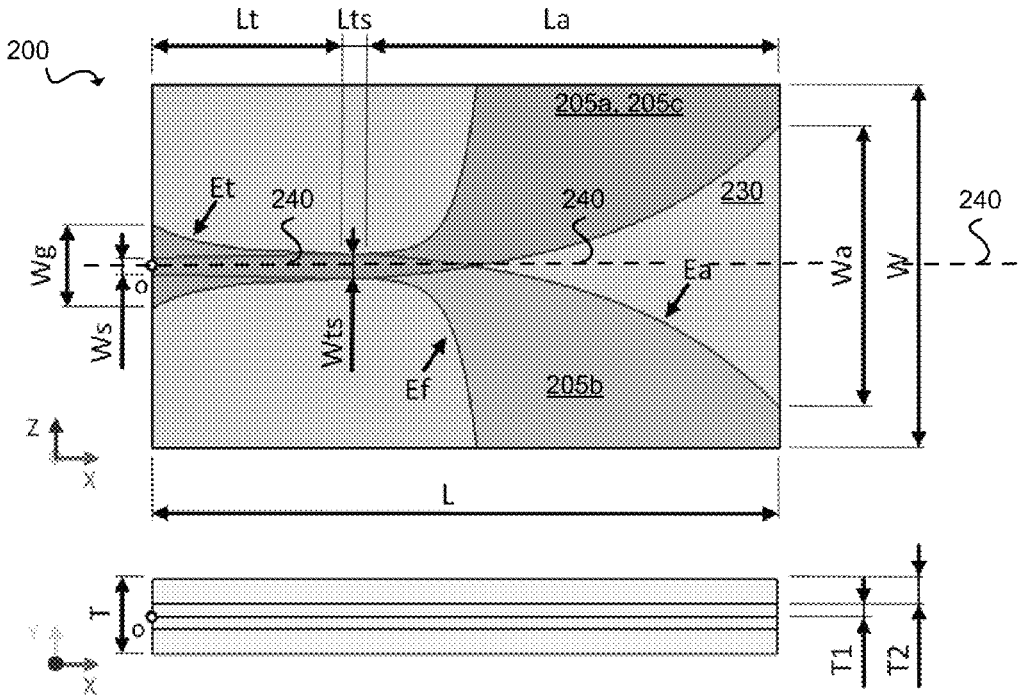
FIG. 2 shows various design parameters of a BAVA, according to one embodiment.

Referring now to FIG. 2, some of the geometric parameters of a BAVA 200 referenced herein include: W, L and T as variables representing the overall width, length and thickness respectively; Ws and Wg corresponding to the width of the stripline and corresponding ground planes 205*a* and 205*c* (note that only one ground plane is depicted in the side-view of the BAVA 200 for clarity); Wts is the width of the tri-strip TL; Wa defines the actual aperture 230 width; and Lt, Lts and La correspond to the transition, tri-strip TL, and aperture length respectively. The dielectric thicknesses are defined by T1 for the supportive substrates and T2 for the stacking layers.

In one embodiment, when the conductors are stacked layers, a longitudinal axis 240 is arranged in a longitudinal cross-sectional plane between the curved conductors as shown in FIG. 2. In preferred embodiments, the orientation of the ground conductors 105*a*, 105*c* are mirror opposites (ignoring the vertical displacement of the conductors in the stacked arrangement) of the central conductor 105*b* about the longitudinal cross-sectional plane.

The exponential curves for the transition, flare and aperture (Et, Ef, Ea respectively) can be defined by:

$$z=\pm A\cdot e^{P(x-B)}+C \quad [1]$$

where A is a scaling factor, P the magnification factor, B the shifting value, and C an offset. Exemplary parameters for one implementation of a BAVA are given in Table 1. Other flaring shapes are also contemplated in addition to the embodiment described herein.

TABLE 1

| Exponential curve parameters based on a system coordinate origin of FIG. 2 | | | | |
|---|---|---|---|---|
| Curve | A | P | B | C |
| Et | $\frac{Wts - Wg}{2(e^{P_t L_t} - 1)}$ | $P_t$ | 0 | $\frac{Wg}{2} - A_t$ |
| Ef | $A_f$ | $P_f$ | Lt + Lts | $\frac{Wts}{2} - A_f$ |
| Ea | $\frac{Wts + Wa}{2(e^{P_t L_a} - 1)}$ | $P_a$ | Lt + Lts | $-\frac{Wts}{2} - A_a$ |

Referring to FIG. 2, in one embodiment of a BAVA, the overall length (L) is selected to be 74 mm with Lt=23 mm, Lts=1 mm and La=50 mm. In some cases, choosing a substrate dielectric with a permittivity slightly higher than the surrounding environment can produce favorable radiation behavior while the thickness of the supportive substrate (T1) has been shown to not significantly influence the antenna performance. In one embodiment of a BAVA, the substrate dielectric has $E_r$=2.94. In some cases, a thicker substrate can lead to better antenna operation.

Figure 4:
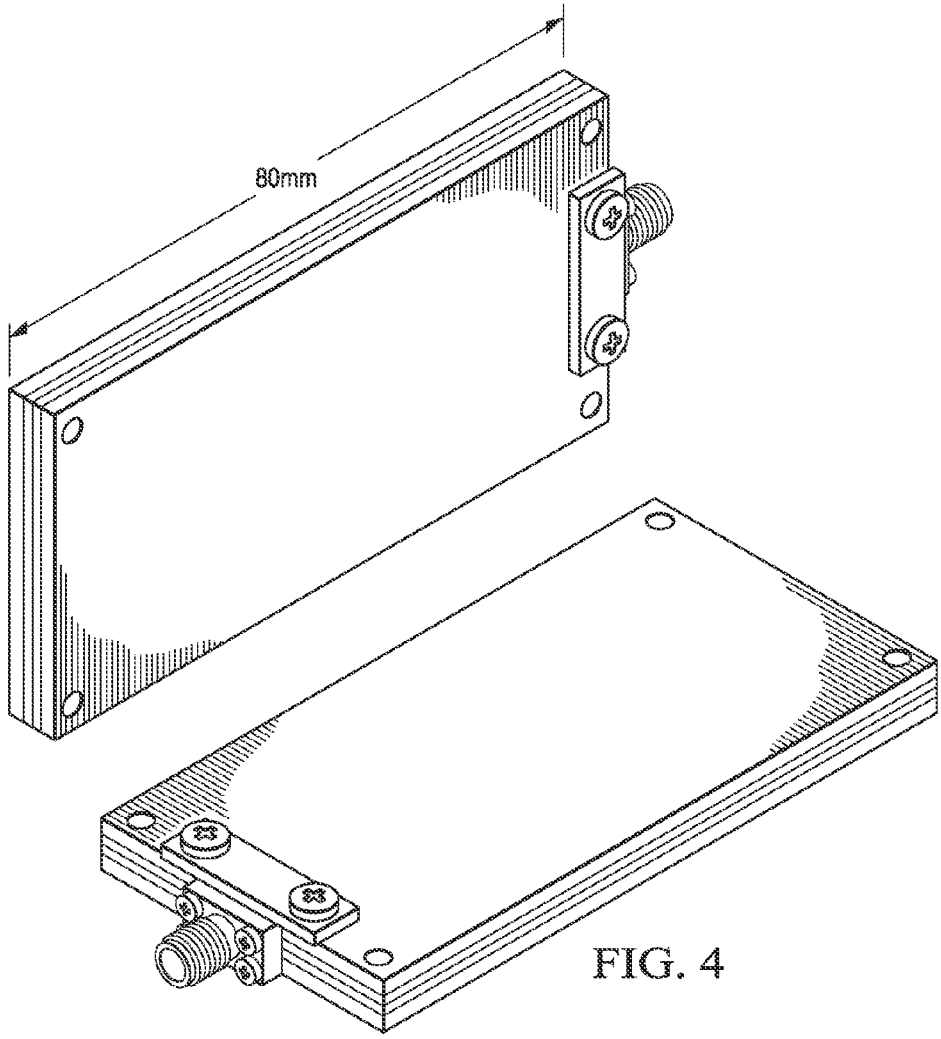
FIG. 4 is a photograph of a BAVA and references to the BAVA scale.

A BAVA of the type described herein, e.g., BAVA 100, can be manufactured or produced by methods known in the art. In one approach, a photolithography process can be used to pattern the copper conductor layers (e.g., ground and conductor layers 105*a-c*). The layers can be bonded using Rogers 3001 bonding film, available from Rogers Corporation (Rogers, Conn.). The bonding film has a relative permittivity of 2.28, similar to the substrates. The feeding structure (e.g., feed 110*a-c* in FIG. 1) can be a custom-made SMA-to-stripline transition having an overall length of 6 mm, excluding the connector. A photograph of a BAVA is shown in FIG. 4.

Stacking Substrate Layers

In general, stacking substrate layers may be placed in contact with the external ground layers of a BAVA. In some cases, when the supporting substrate layers of a BAVA have a permittivity different than the surrounding environment, a squint of the radiation pattern can result. Without wishing to be bound by theory, this behavior seems to originate from an unequal dielectric loading between the conductor and ground plate. One solution that restores symmetry involves stacking an additional substrate layer on the external side of the antenna.

Figure 30:
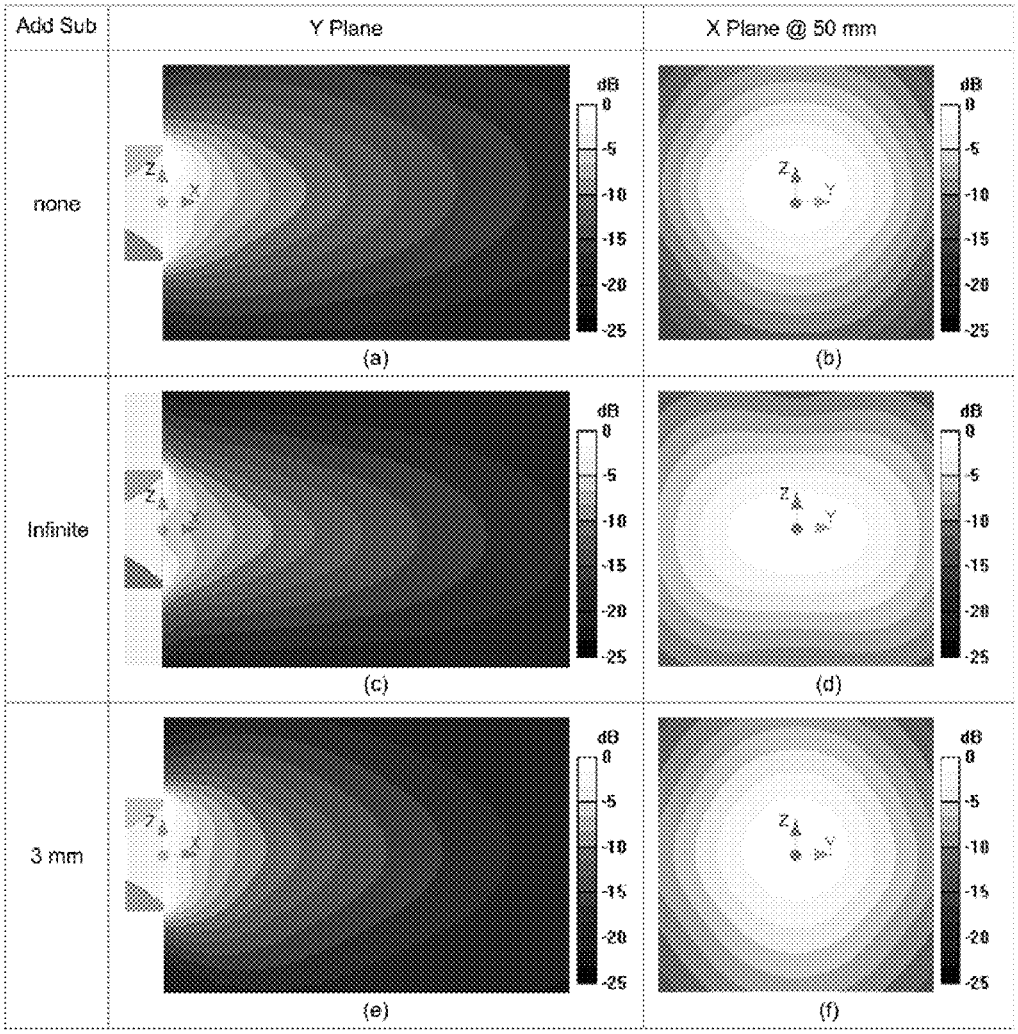
FIGS. 30A-30F illustrate the radiated energy flux density in front of the antenna when A-B no stacking substrate layers are used, C-D infinite stacking layers are used, E-F 3 mm thick stacking layers are used.

Referring now to FIG. 30, as proof of concept, a BAVA structure with supportive layers of relative permittivity of 5 has been evaluated (where the surrounding environment has a relative permittivity of 2.5). Without any additional substrate, a squint was observed in the main radiation beam (FIGS. 30A-B). The structure was simulated with an infinite substrate coating having the same permittivity as the supporting substrates and then a practical case with a 3 mm thick substrate layer on both sides of the antenna. The infinite substrate coating seemed to cause the radiation squint to vanish, as observed in FIGS. 30C-D. The 3 mm thick additional substrates reduced the original squint by moving the maximum field intensity from z=3.8 mm to z=1.6 mm at 50 mm (FIGS. 30C-D).

When the stacking layers were used, the antenna efficiency was increased. In one BAVA implementation, an increase in efficiency of 20% was observed between antennas with and without stacking substrates and immersed in lossy canola oil.

BAVA-D

In general, a director can be incorporated into the aperture region of an antenna, e.g., a BAVA (BAVAs that incorporate a director are hereinafter referred to as a BAVA-D). It will be understood that the directors discussed herein are framed in various embodiments of BAVA's, however, the use of dielectric directors is equally contemplated in other types of traveling wave antennas, for example, a TEM horn antenna, and various tapered slotline antennas. In general, a director can provide advantages when, for example, a narrow or more focused radiation beam is preferred. Some of the geometric details of an exemplary director are shown FIGS. 5A-C, and a photograph of the constructed BAVA-D is shown in FIG. 6.

Figure 5A:
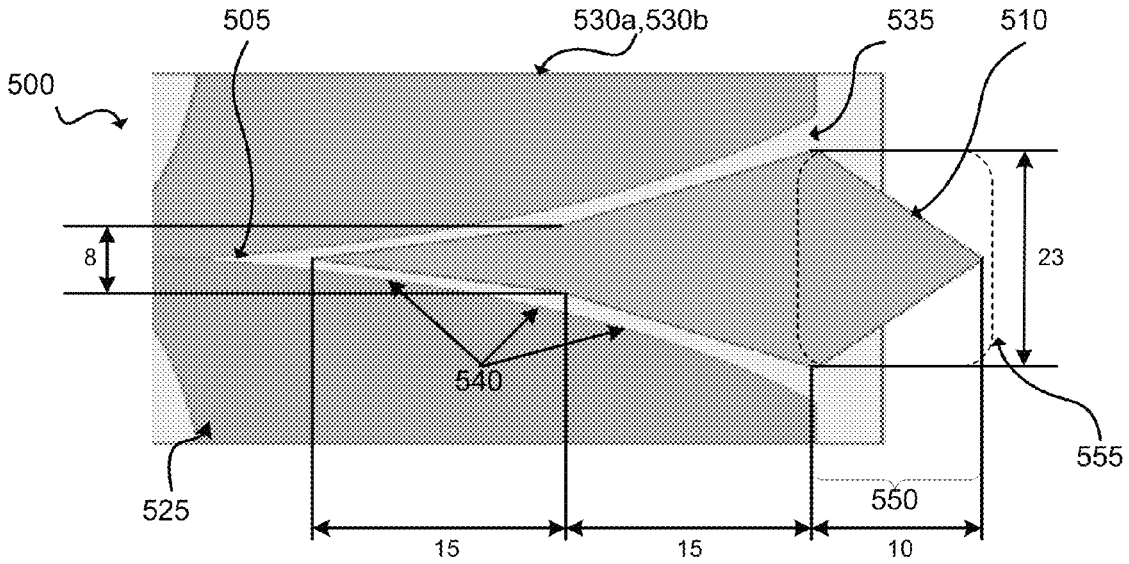
FIGS. 5A-5C show various perspectives of a BAVA with director ("BAVA-D"), according to one embodiment.
Figure 5B:
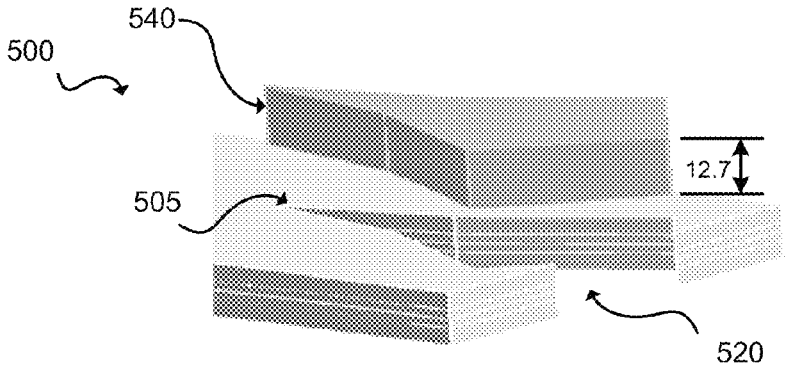
Figure 5C:
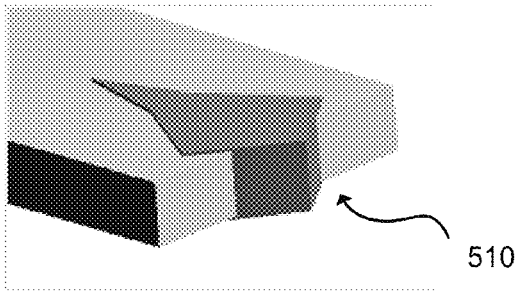
Figure 6:
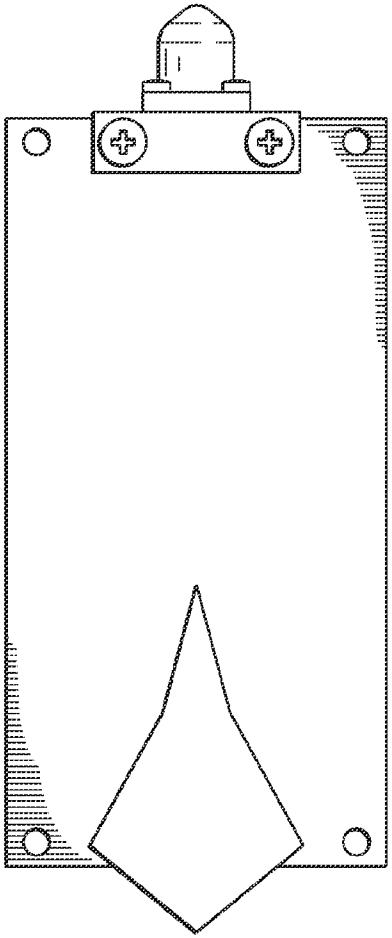
FIG. 6 is a photograph of a BAVA-D and references to the BAVA-D scale.

Referring now to FIGS. 5A-C, in one embodiment of a BAVA-D 500, a BAVA director 510 can be a shaped dielectric (e.g., substantially diamond-shaped) positioned at least partially within the aperture 520. In some embodiments of a BAVA-D 500, the director 510 may be positioned completely within the aperture region. In other embodiments of a BAVA-D 500, the director 510 may be positioned completely within the area defined by the aperture region plus any portion of the stacking or dielectric layers that may extend beyond the aperture region. In yet another embodiment of a BAVA-D 500, the director 510 may be positioned such that a portion of the director 510 is within the aperture region while another portion extends beyond the area of the aperture region and the dielectric and stacking substrates, as best illustrated in the top-down perspective view of FIG. 5A. The director 510 can include a profile that reduces the likelihood of creating radiation reflections from the lower and upper boundaries, i.e., the start 505 and the end 535 of the aperture 520 respectively. The portion of the director in the antenna structure can substantially follow a curvature (generally indicated at 540) of the conductor 525 on one side and that of the ground plates 530*a*, 530*b* on another side. A portion of the director 510 extending outwardly from the aperture (generally referred to by indicator number 550) can include a triangle-like shape 555 that reduces the likelihood of creating reflections within the aperture 520. In general, curved portion 540 in FIG. 5A illustrates a flared portion that extends from the start 505 to a distal portion of the antenna.

In some cases, the director can be a material having a select dielectric permittivity, and can generally be enclosed in the BAVA aperture, e.g., aperture 130 in FIG. 1. In some embodiments of a BAVA-D, the director is made of a material having higher dielectric permittivity than that of the surrounding dielectric layers. In some embodiments of a BAVA-D, the director is made of multiple materials with a range of dielectric constants.

In one exemplary embodiment of a BAVA-D, the maximum width is 26 mm and the total length of the director is 40 mm, which includes 10 mm of director material that protrudes outside of the original antenna (e.g., that indicated by reference numeral 550 in FIG. 5). In this embodiment, the substrate length of the BAVA can be extended to accommodate the mechanical placement of the director. The director can be made, for example, from Eccostock HIK material, having a relative permittivity of 6 (double that of the original substrate) from Emerson and Cuming (Billerica, Mass.). Other suitable permittivities and/or materials may be used for the director, however.

In general, a director may be incorporated into the BAVA aperture by various methods. For example, a director may be machined out of a selected dielectric material such that the contours of the flared portions of the ground and conductor planes match a portion of the director. In some embodiments, a small recess may exist in-between the director and the conductors, i.e., the director can be fixed at a selected distance from the metallization. In some embodiments the director may be affixed to the BAVA aperture using a selected adhesive, for example Eccostock cement from Emerson and Cuming Microwave Products.

Simulations

Figure 3:
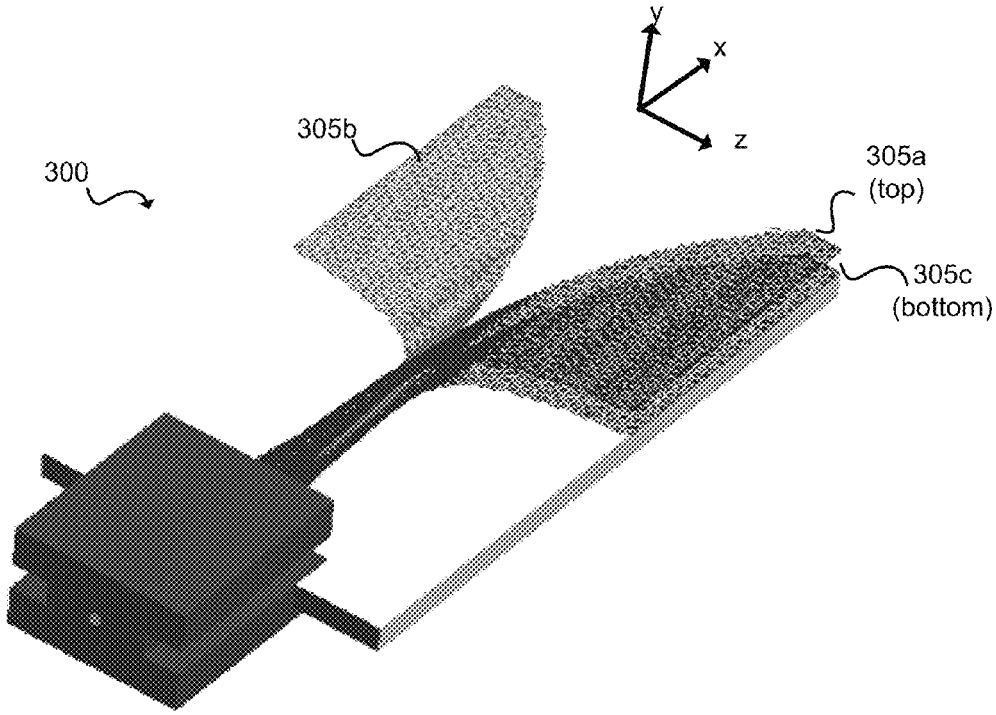
FIG. 3 shows a perspective view of a BAVA, according to one embodiment.

Prior to implementation of a physical device, the performance of a particular BAVA or BAVA-D design can be assessed using computer simulations, for example using the SEMCAD X computer program available from SPEAG AG, Switzerland. When such simulations are performed, a coaxial TL can be connected to the stripline to represent the SMA-to-stripline transition used in the physical implementation of a BAVA or BAVA-D. Referring now to FIG. 3, an exemplary modeled antenna 300 may have ground planes 305*a*, 305*c* and conductor 305*b* as indicated.

In some cases, the performance of a BAVA or BAVA-D can be evaluated in terms of $S_{11}$, the half energy beamwidth (HEBW) and fidelity.

Without wishing to be bound by theory, in some cases, for a classical narrow band application, the power radiated away from the antenna can be used to evaluate the radiation pattern. In the case of a pulsed signal a consideration of the energy content of the signal is preferred. The radiated energy pattern can be calculated using [2] where the radiated electric field ($E_{rad}(\theta,\phi,t)$) is squared and integrated over time before division by the intrinsic impedance of the medium $\eta_0$ which is usually air.

$$U_T(\theta, \varphi) = \frac{1}{\eta_0}\int_{-\infty}^{\infty}|E_{rad}(\theta, \varphi, t)|^2\, dt\left[\frac{Ws}{m^2}\right] \quad [2]$$

This equation is defined for the far field, while the fields examined to evaluate the BAVA and BAVA-D are closer to the antenna, or in the near field. In addition, the far field concept assumes an infinitely small antenna situated at the spherical coordinate origin, and is valid in a far-field scenario but may not be valid in the near field. It can be difficult, therefore, to define an appropriate axis origin as reference over the antenna structure. A practical disadvantage may arise if the medium is not uniform, as a specific intrinsic impedance may be needed for each data point.

A Poynting vector (S) can be used to calculate the radiated energy which may provide advantages over the approach described above. In a time-harmonic problem, the vector can represent the density of power flux of an electromagnetic wave, with the vector directed toward the traveling direction. For a time harmonic wave, the vector can include the cross product between an electric field and the complex conjugate of a magnetic field, E and H* respectively:

$$S = \frac{1}{2}\mathrm{Re}\{E \times H^*\}\left[\frac{W}{m^2}\right] \quad [3]$$

Equation [3] can also be used with real time domain data. By integrating the result over time, the EFD(x,y,z) can be obtained:

$$\vec{E}FD(x, y, z) = \int_{-\infty}^{\infty}\vec{E}(x, y, z, t)\times\vec{H}(x, y, z, t)\, dt\left[\frac{Ws}{m^2}\right]. \quad [4]$$

The final result is a vector that can indicate the direction of energy flow, which is useful in the near field, while the norm of the vector can correspond to the value that would be calculated using [2], if considered at the same location. In most cases the intrinsic impedance term is not a required variable since the magnetic field can be used to compute the energy.

Figure 7:
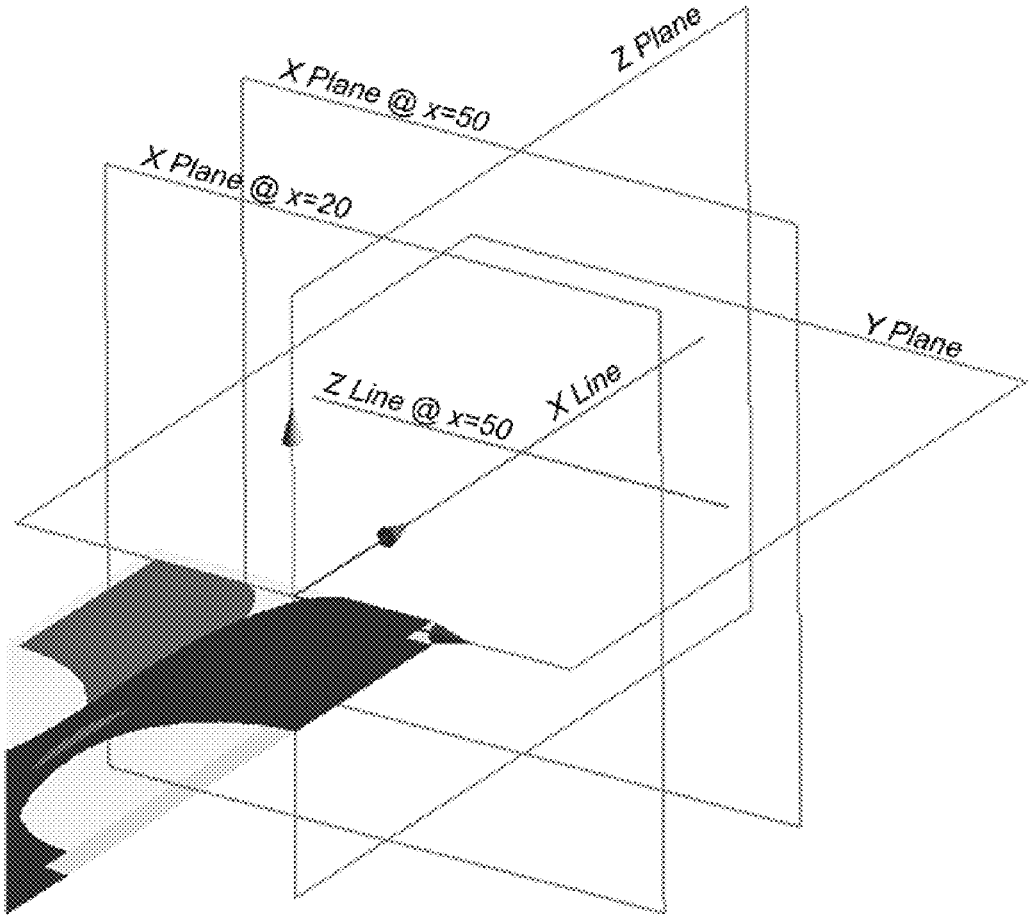
FIG. 7 illustrates various field sensor reference planes.

Simulated 'field sensors' can be used to record a field value during a simulation at certain points in space. The sensors may record the field along a line, in a plane, or even an entire volume. Line and plane sensors used for the simulations described are herein referred to 'X line' or 'Y plane' as illustrated in FIG. 7. The fields recorded along a line or in a plane may be processed as appropriate to calculate EFD. For example, practical calculation of EFD results in the following equation:

$$\overline{EFD}(x, y, z) = \int_0^{T_{sim}}\vec{E}(x, y, z, t)\times\vec{H}(x, y, z, t)\, dt\left[\frac{J}{m^2}\right], \quad [5]$$

where E and H are the field values in the time domain from the simulation and $T_{sim}$ is the total simulation duration.

Figure 8:
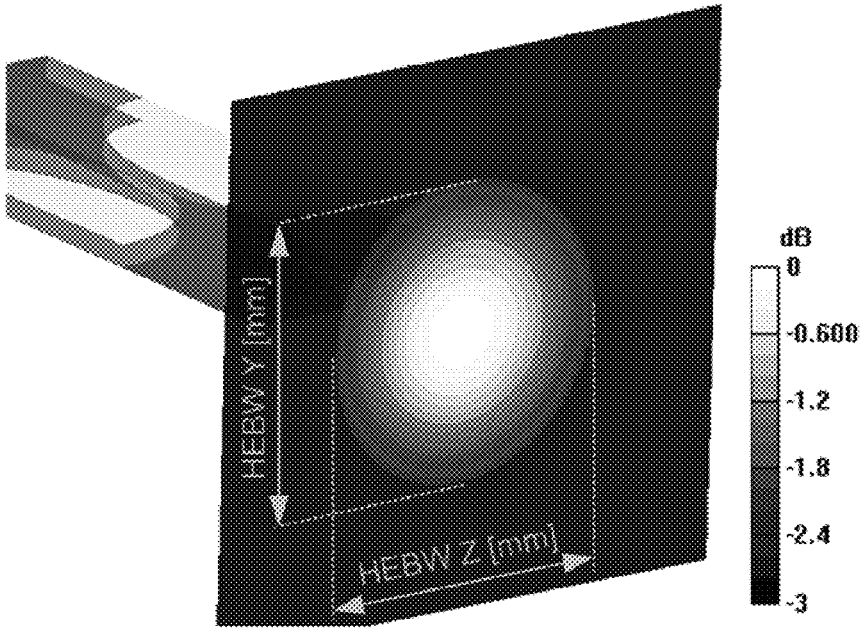
FIGS. 8A and 8B show simulation results illustrating the concept of the half-energy beamwidth in the near field.
Figure 8:
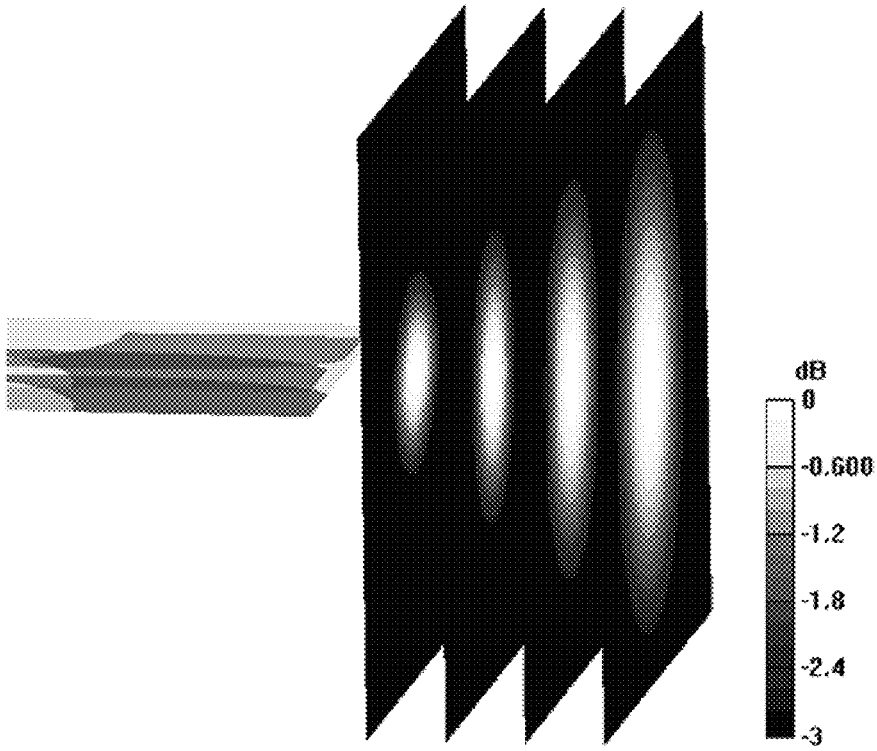

To assess the radiation pattern in the near field, the EFD can be computed over adequate areas of interest around the antenna, without having to be related to the axes origin. A qualitative view of the energy pattern for a BAVA is illustrated in FIG. 8A. The pattern can be produced in a post-processing step based on the data recorded by the field sensors; this step can be programmed into SEMCAD X using the Python scripting environment, for example. Since, in most cases, the propagation direction of the energy is known, an additional feature that records the total energy entering and leaving the sensor boundaries can be added into the algorithm. For example, if an X plane sensor is placed away from the antenna, it is possible to record how much energy goes through the sensor in one direction or the other. In some cases, if an antenna is surrounded by sensors, antenna efficiency can be computed.

The Half Energy Beamwidth (HEBW) can be an acceptable way to quantify a radiation pattern. In the far-field, the HEBW can be the angular separation of the points on a specific plane where the radiated energy is one half of the maximum. The HEBW can be defined in the near field by measuring the half energy contour on a plane normal to the main radiation direction, using the maximum energy located on the same plane as reference. The half energy contour is usually elliptical and the HEBW can be quantified by measuring its two axes as shown in FIG. 8A. In some cases the HEBW can be evaluated at different distances from the antenna aperture as illustrated by FIG. 8B.

In some cases, a drawback of this method is that the resulting HEBW can depend on the distance from the antenna, which can complicate the performance comparison between two antennas. FIG. 8B shows that when the HEBW is measured at many different locations away from the antenna, the beam spreads out in a conical shape. In this case, the beam could be modeled using an equivalent angular beamwidth in conjunction with a corresponding beam origin.

Figure 9:
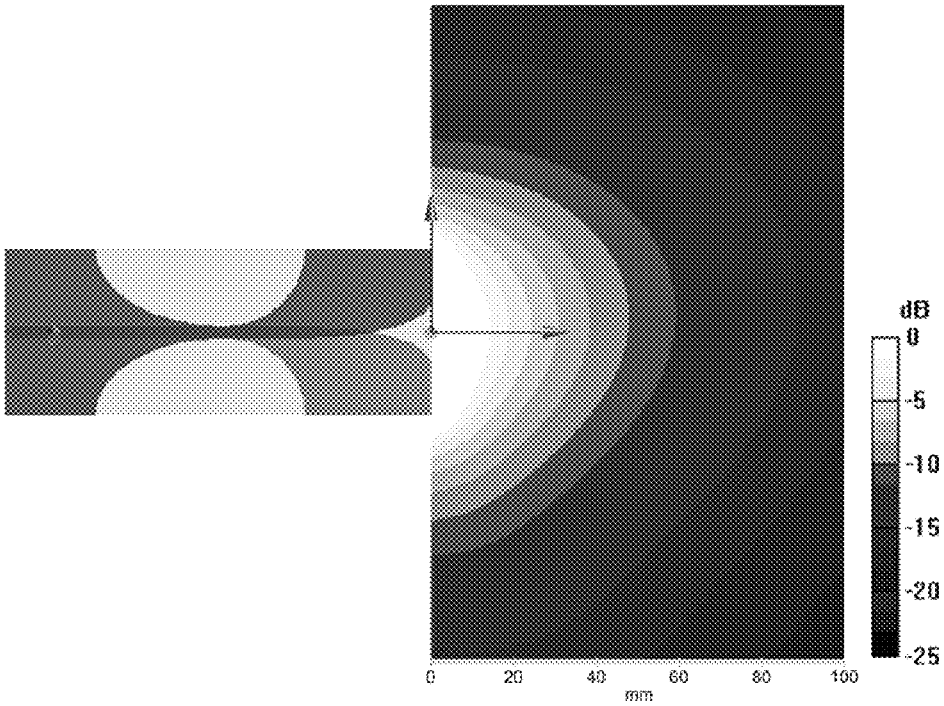
FIGS. 9A and 9B show simulation results illustrating the concept of half-energy beam in the near field.
Figure 9:
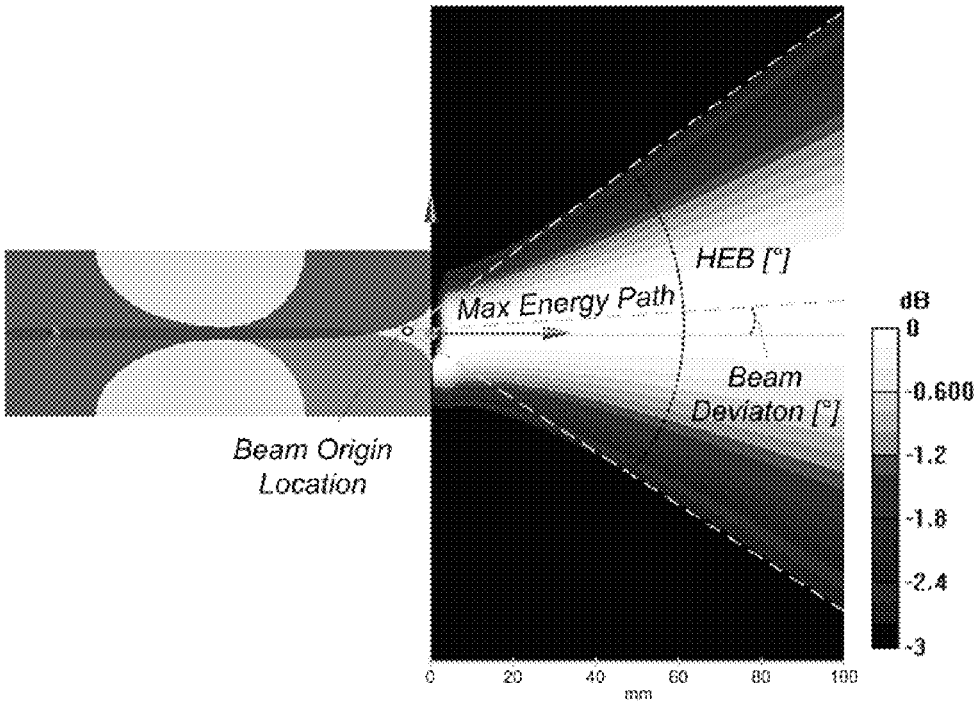

In order to implement this method according to one embodiment, the EFD values located at a common distance from the antenna aperture can be normalized to the maximum energy recorded at the same distance. FIG. 9B shows a result including a Half Energy Beam (HEB) which was produced using a Python script based on the EFD data shown in FIG. 9A. The half energy contour and the maximum energy path can be fit to linear functions that are used to define the beam origin location, HEB and beam deviation, as shown in FIG.

9B. A beam deviation metric may be needed when the direction of the main beam is not aligned with the coordinate axis.

Figure 10:
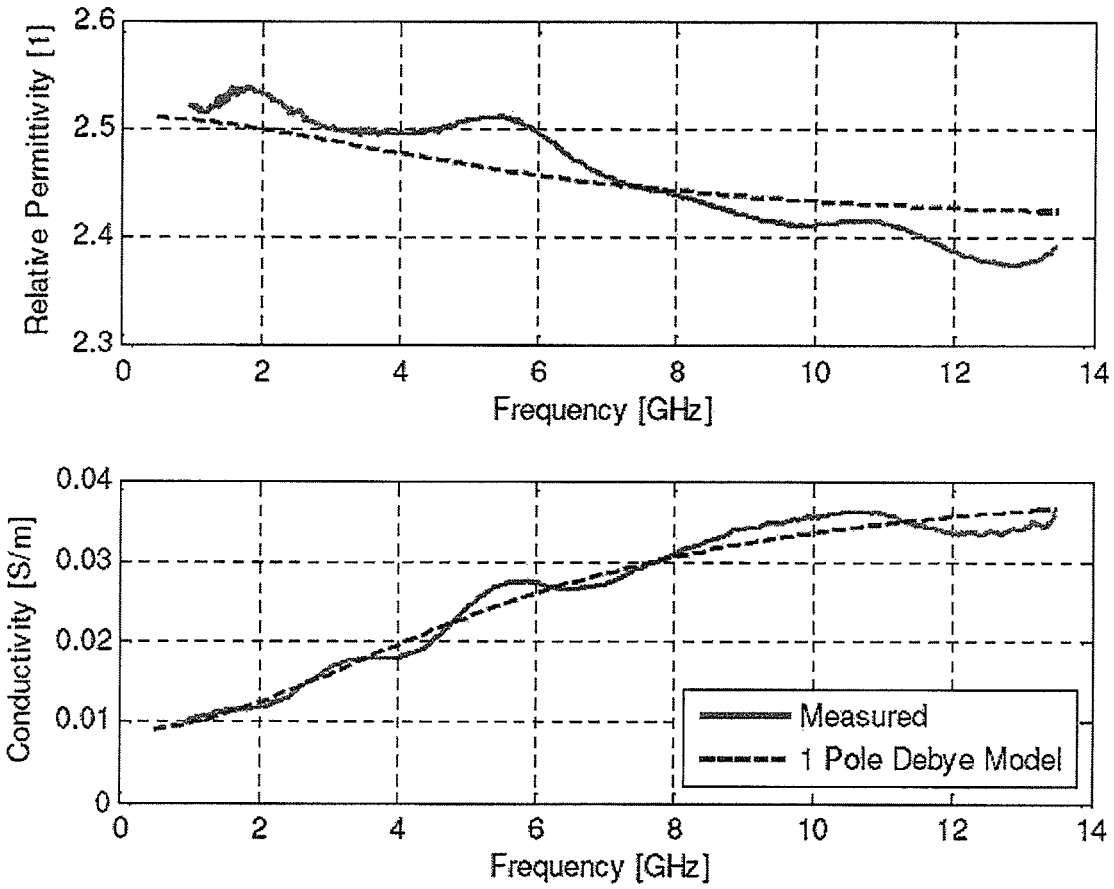
FIG. 10 shows charts of permittivity and conductivity versus frequency for canola oil.

FIG. 10 shows that canola oil is a dispersive material whose permittivity and conductivity can vary with frequency. For most simulations incorporating canola oil as the background, the average permittivity value of $\epsilon_r$=2.5 and the maximum conductivity of 0.04 S/m can suffice. In some cases, however, such as when reflections from an object placed away from the antenna are received, it may be necessary to simulate the oil as a dispersive material. This can be accomplished, e.g., using the 'Dispersive Model Parameter Optimization' tool available in SEMCAD X; a single pole Debye model was found to be suitable to fit most canola oil properties.

The representation of the HEB in the near field can be very useful since it models the actual radiation behavior and therefore allows straightforward comparison between different antennas or different antenna configurations. It should be noted that, in some cases, this representation of the radiation beam becomes accurate only at a certain distance from the antenna aperture. In the examples given herein, the representation can be considered correct beginning at a distance of 30 mm from the antenna aperture.

In one approach to antenna assessment, the antenna fidelity can be a measure of how faithfully an excitation pulse is transmitted or received by the BAVA, and can reflect the distortion due to the frequency band limitation and phase non-linearity. The transmission fidelity (F(x,y,z)) can be calculated using [6]. In one approach, the calculation can include maximizing a cross correlation between a component of the electric field measured at a specific position (E(x,y,z,t)) and a reference signal r(t) which is the time derivative of the excitation signal. Both signals are normalized according to [7] and [8]. In some cases, the z-component of the electric field dominates the radiated field, and therefore the fidelity can be calculated using only the z-component:

$$F(x, y, z) = \max_{\tau}\left(\int_0^{T_{ref}} \hat{E}_z(x, y, z, t+\tau)\hat{r}(t)\,dt\right); \quad [6]$$

$$\hat{E}_z(x, y, z, t) = \frac{E_z(x, y, z, t)}{\left[\int_0^{T_{sim}} |E_z(x, y, z, t)|^2\,dt\right]^{1/2}}; \quad [7]$$

$$\hat{r}(t) = \frac{r(t)}{\left[\int_0^{T_{ref}} |r(t)|^2\,dt\right]^{1/2}}; \quad [8]$$

where $T_{ref}$ is the time length of the reference signal and $T_{sim}$, remains the total simulation time.

In one approach, reflections from the antenna ($S_{11}$) can be simulated using a broadband excitation, such as the signal provided by the SEMCAD X software package. The simulations for the EFD and fidelity, however, can be computed using an ultra-wideband pulse excitation of the form:

$$V(t)=V_0(t-t_0)e^{-(t-t_0)^2/\tau^2}, \quad [9]$$

where $V_0$ is used to adjust the amplitude of the pulse, $\tau$=62.5 ps, and $\tau_0=4\tau$. In some cases, a disadvantage of a time based characterization includes its dependency on the antenna excitation waveform. The use of different pulses will produce different energy radiation pattern(s).

In some implementations of a BAVA or a BAVA-D, the antenna can be used in an immersion medium. One exemplary immersion medium is oil, e.g., canola oil, however other immersion media are equally contemplated. Tissue sensing adaptive radar imaging for breast tumor detection, U.S. patent application Ser. No. 10/942,945, now fully incorporated by reference, describes an implementation of a submersible antenna where a BAVA or BAVA-D is contemplated for use. A tissue sensing adaptive radar (TSAR) system can utilize canola oil as a preferred immersion medium, thus the electrical properties can be applied and integrated into simulations of a BAVA or BAVA-D.

In one embodiment of a BAVA, the transition dimensions Wg, Ws and Wts (FIG. 2) are selected to provide TLs having 50 Ohms characteristic impedance at both ends and $P_t$ is selected to get the best transmission coefficient ($S_{21}$) when two transitions are placed back to back. The dielectric is RT/Duroid® 6002 from Rogers Corporation, which has a relative permittivity of 2.94. The thickness T1 is 1.524 mm, which was purposefully chosen to accommodate the coax-stripline transition, and T2=3.048 mm, which was the thickest material available. The various lengths are: L=74 mm, Lt=23 mm, Lts=1 mm, and La=50 mm. The remaining parameters are: W=44 mm, Wa=34 mm, Wg=10, Ws=2 mm, Wts=2.24 mm, T=~9.2 mm, $P_t$=−0.15, $P_f$=0.4, $P_a$=0.05 and $A_f$=0.1.

For this embodiment of the BAVA, a director is designed out of an Eccostock HIK material with a relative permittivity of 6. The director generally follows the shape of the aperture, as described previously. The director dimensions are shown in FIG. 5, and include maximum width of 26 mm and total length of the director of 40 mm. This results in 10 mm of director material that protrudes outside of the original antenna (e.g., that indicated by reference numeral 550 in FIG. 5). In addition, the substrate length of the BAVA is extended by an additional 4 mm to accommodate its mechanical placement.

Figure 11:
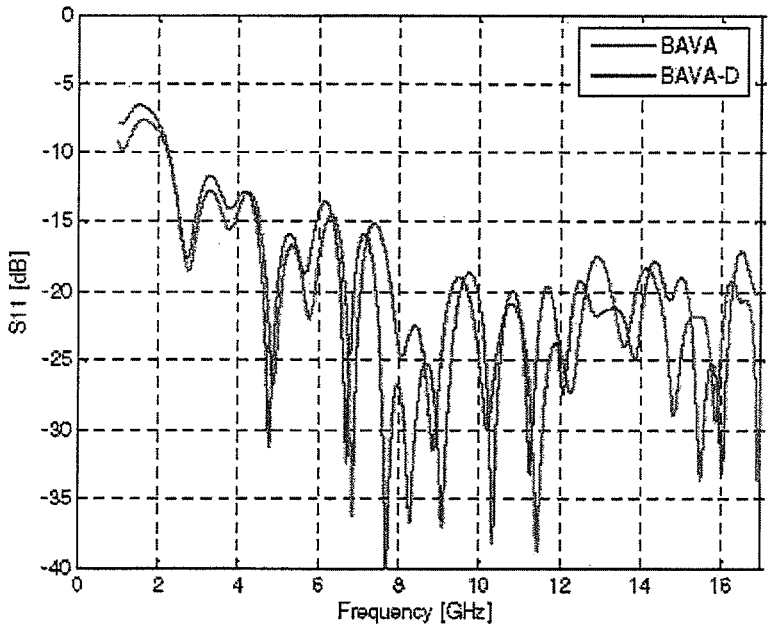
FIG. 11 is a chart of the simulated $S_{11}$ versus frequency for one embodiment each of a BAVA and a BAVA-D.

Simulations of a BAVA and BAVA-D are performed with the antennas immersed in canola oil. Referring now to FIG. 11, there are no substantial differences in reflections ($S_{11}$) between the two versions, except slightly higher reflections are observed at lower frequencies for the BAVA-D. The antennas show better than −7 dB reflection between 1 and 12 GHz.

Figure 13:
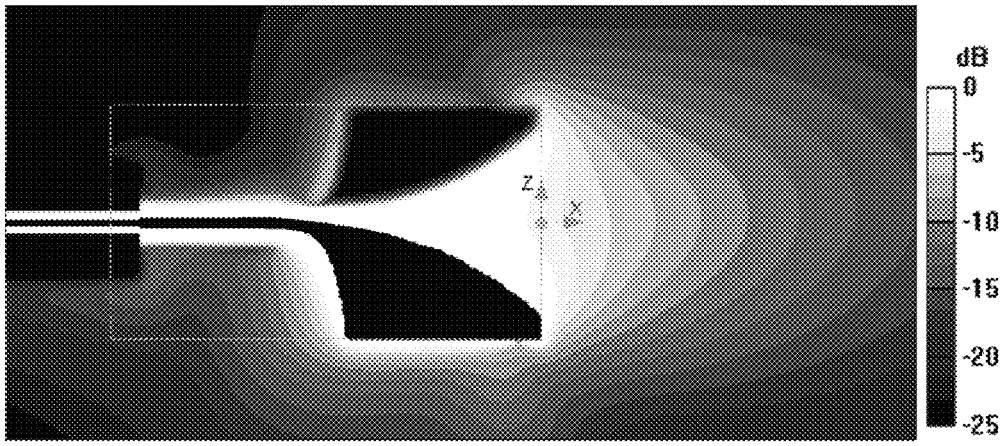
FIGS. 13A and 13B show simulation results of energy flux density for one embodiment of a BAVA and BAVA-D over the Y-plane.
Figure 13:
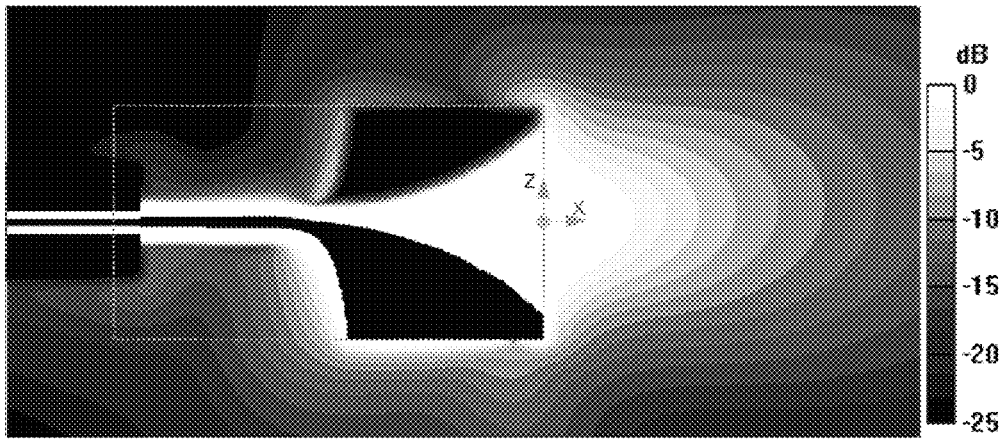
Figure 14:
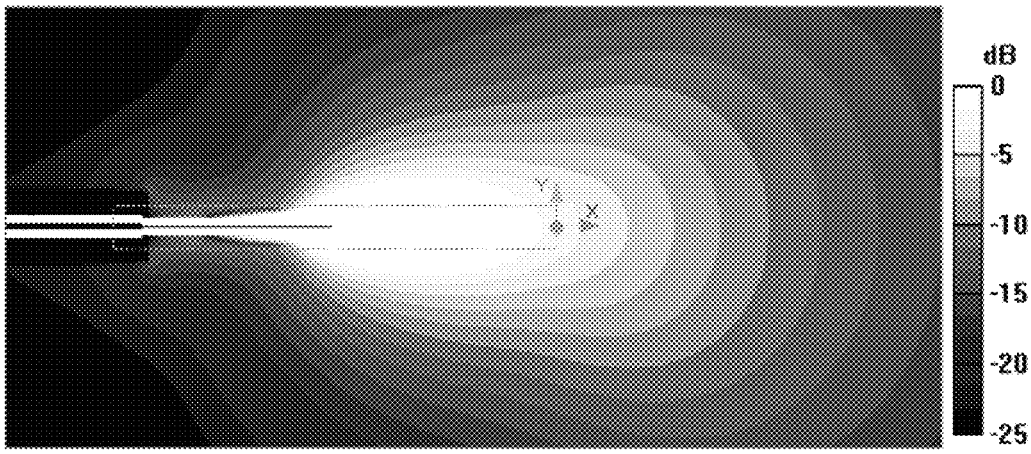
FIGS. 14A and 14B show simulation results of energy flux density for one embodiment of a BAVA and a BAVA-D over the Z-plane.
Figure 14:
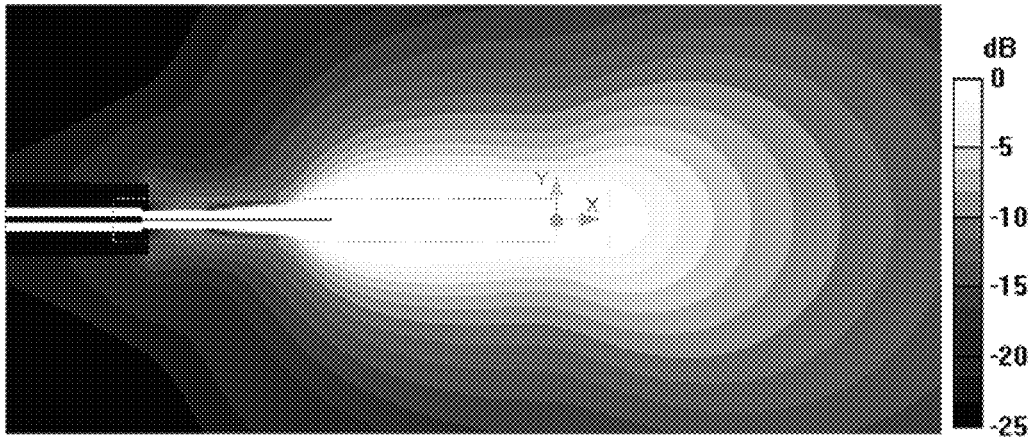
Figure 15:
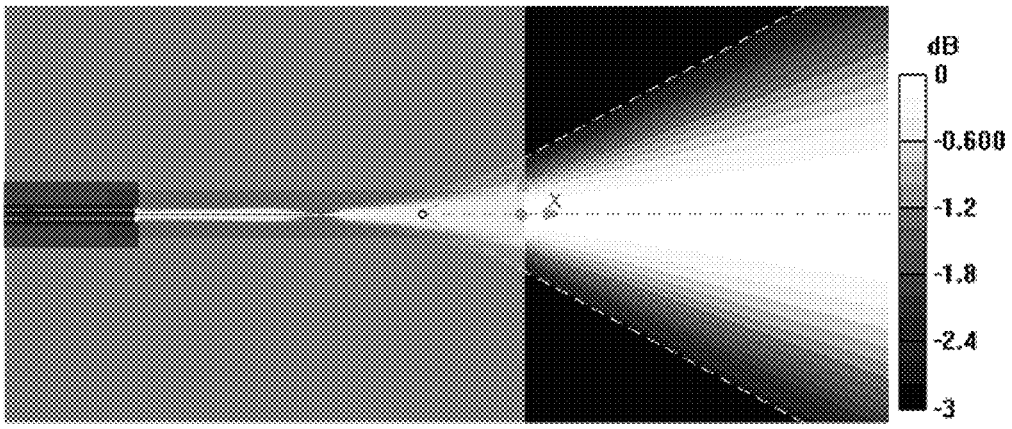
FIGS. 15A and 15B show simulation results of the half-energy beam from one embodiment of a BAVA and BAVA-D over the Y-plane.
Figure 15:
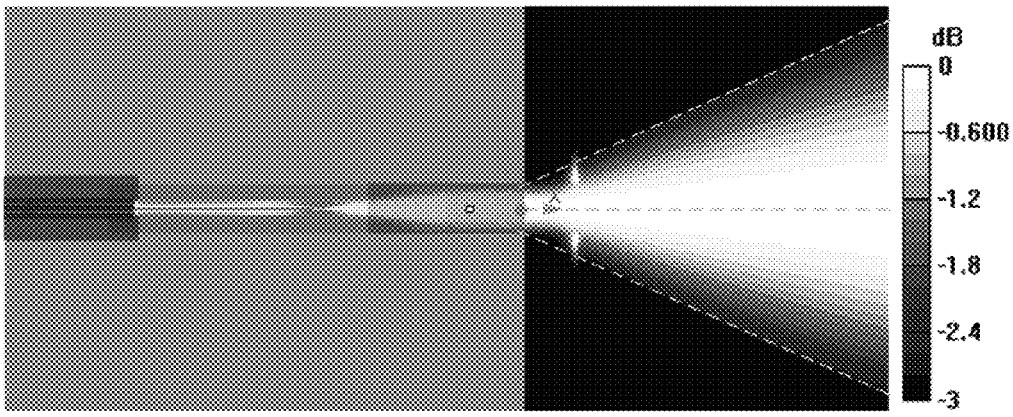

To evaluate the radiation pattern in the near-field, the HEBW can be defined on a plane orthogonal to the endfire direction (+X in FIG. 7) that is positioned a given distance from the antenna aperture. To compute the HEBW, the EFD can be computed on a series of planes orthogonal to X and ranging from the antenna feed to a distance of 70 mm away from the aperture. The EFD calculations are shown for both a BAVA and a BAVA-D in FIGS. 13 and 14, indicating endfire radiation behavior and the effect of the director on the radiation directivity for the BAVA-D. Specifically, the EFD plots in FIGS. 13A-B indicate a narrower beam and increased intensity at a selected distance away from the antenna with the director present. The EFD plots in FIGS. 14A-B show that the director contains the fields closer to the antenna structure when compared to the director-free case. The HEB was computed based on the EFD data for qualitative purposes and the results are shown in FIGS. 15A-B and 16A-B. This involves fitting curves to points where the EFD distribution is half of the maximum value, then tracing the curves to an intersection point located in the antenna aperture. The angle between the curves is taken as the half-energy beamwidth. The beam origin, or intersection of the curves, is also noted.

TABLE 2

Simulated beamwidth dimensions for the BABA and BAVA-D.

| | Parameters | | | | |
|---|---|---|---|---|---|
| | Y plane | | Z plane | | |
| | Antenna | | | | |
| | BAVA | BAVA-D | BAVA | BAVA-D | Unit |
| HEB | 32 | 34 | 60 | 51 | [°] |
| Beam Deviation | 3 | 4 | 0 | 0 | [°] |
| Beam origin | x = −28<br>z = −2 | x = −15<br>z = −1.3 | x = −17<br>y = 0 | x = −8<br>y = 0 | [mm] |
| HEBW (20 mm) | 34 | 23 | 45 | 42 | [mm] |
| HEBW (50 mm) | 44 | 40 | 80 | 58 | [mm] |

Figure 16:
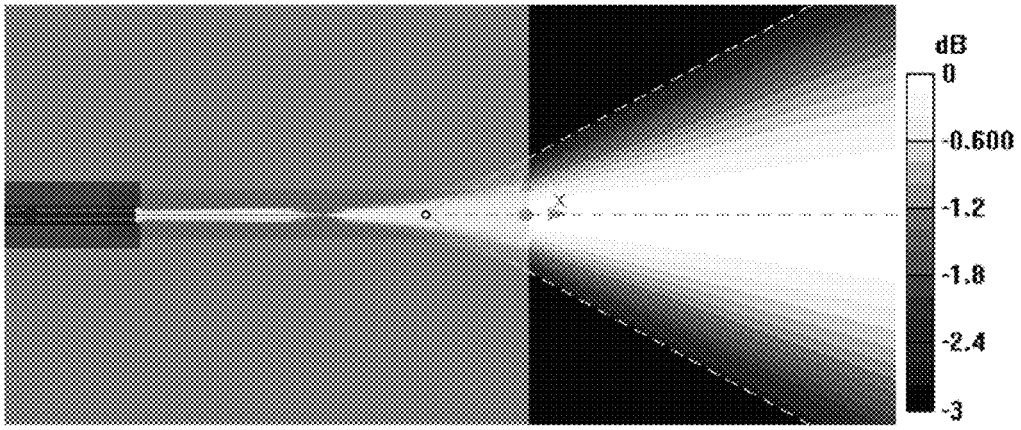
FIGS. 16A and 16B show simulation results of the half-energy beam from one embodiment of a BAVA and BAVA-D over the Z-plane.
Figure 16:
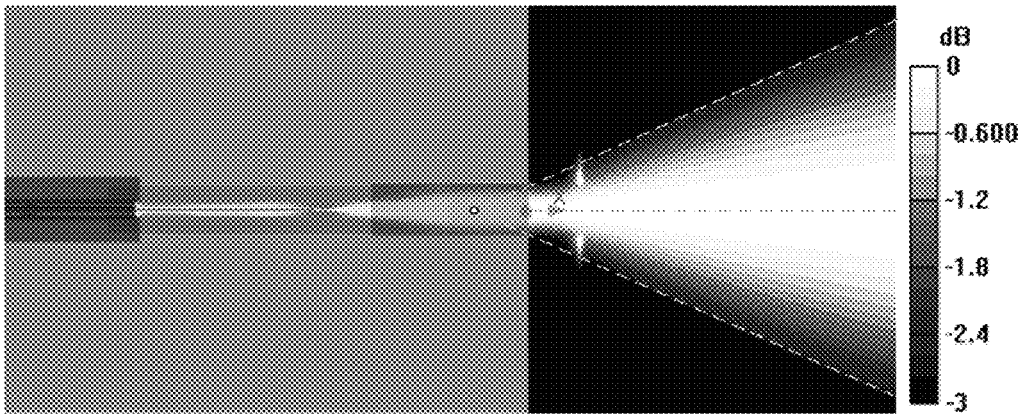

Referring now to FIGS. 16A-B, the pulse energy appears more concentrated in the center of the antenna structure when the director is present. The HEB substantially follows the edges of the substrate until the end of the structure for a BAVA-D while the HEB begins to expand outside the substrate boundary around 15 mm before the end of the BAVA. Referring now to Table 2, calculated numerical HEB values for a BAVA and BAVA-D, the effect of the director on the beamwidth can include an overall narrowing on both axes as demonstrated by the usual HEBW values at 20 and 50 mm from the antenna aperture. Without wishing to be bound by theory, the improved radiation patterns that result from director use may not necessarily be due to a smaller HEB angle; instead, the advantages may be mostly due to a shift of the beam origin towards the antenna aperture. For example, the HEB on the Y plane increases from 32° to 34° when the director is used. The HEBW measured at 20 and 50 mm, however, are smaller because the energy starts to expand further away in the x direction, as expressed by the shift of the beam origin from x=−28 to x=−15 mm when using the director. On the Z plane the director reduces the HEB from 60 to 51° while moving the focal point from x=−17 to x=−8 mm. The beamwidth on the Y axis, therefore shrinks as indicated by the HEBW value at 20 and 50 mm.

Figure 12:
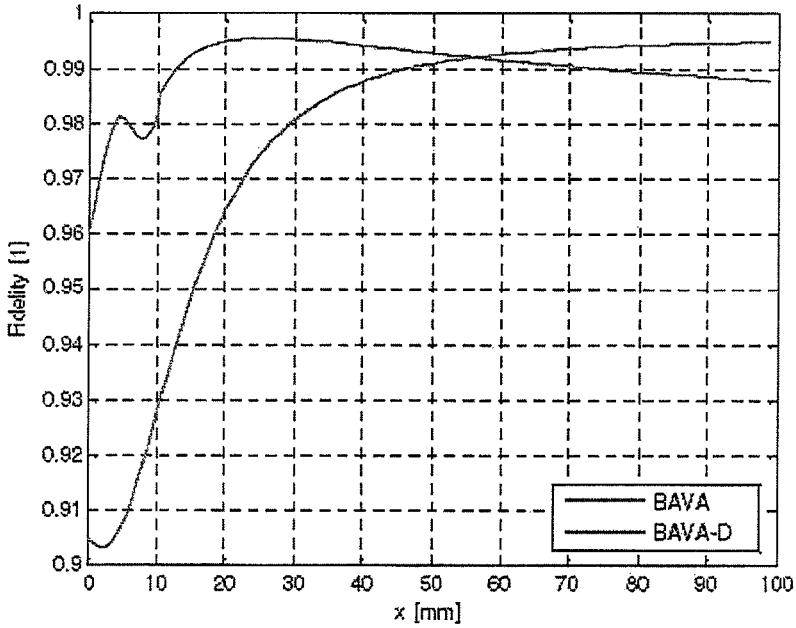
FIG. 12 is a chart of the simulated fidelity versus distance for one embodiment each of a BAVA and a BAVA-D.

The simulated fidelity is approximately 0.9 at the aperture and above 0.96 at distances of 20 mm, as shown in FIG. 12. This order of magnitude is considered as high fidelity for an antenna that radiates electromagnetic pulses. The fidelity is not deteriorated when the director is present, in fact it is higher closer to the antenna. This effect is due to a more constant endfire radiation behavior across the frequency band when the director is used.

Figure 17:
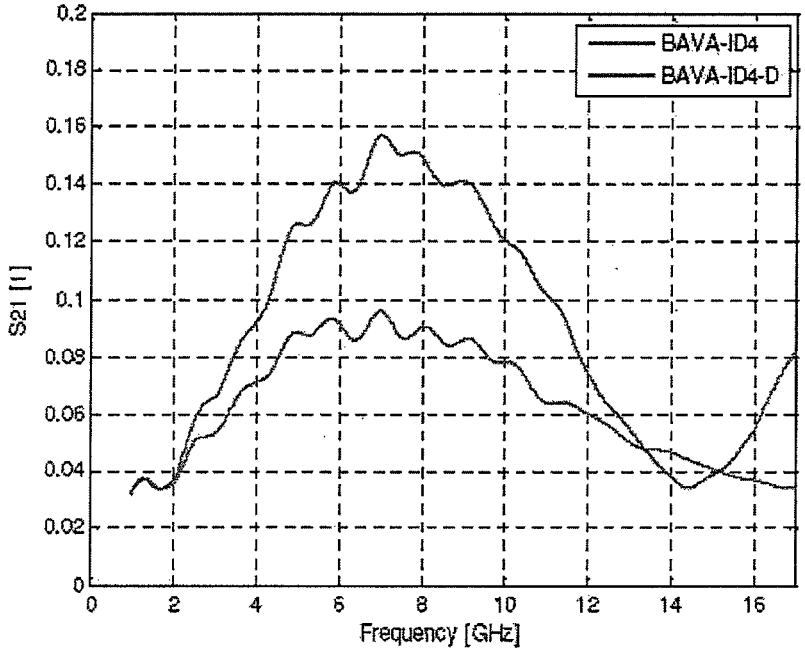
FIG. 17 is a graph of the simulated $S_{21}$ versus frequency for one embodiment each of a BAVA and a BAVA-D.

In one approach, the transmission parameter ($S_{21}$) is a parameter that can be used to better understand the director effect in the frequency domain. The information given by $S_{21}$ is the amount of energy that is transmitted between the two antennas. The higher the value of $S_{21}$, the better the transmission of the energy, and more focused the beam. As shown by FIG. 17, the presence of the director increases dramatically the $S_{21}$ magnitude between 2 to 12 GHz while a null appears at 14 GHz. An antenna with higher $S_{21}$ will receive more reflected energy from an object placed in front of the antenna. In other words, the BAVA-D is expected to provide a larger amplitude response for the same object.

Measurements

Simulations have shown that the director effects a noticeable improvement in the radiation patterns produced from a Vivaldi antenna. The following measurements were obtained to compare actual signals with the simulations; the antennas were immersed in canola oil and data were recorded by an Agilent 8719ES Vector Network Analyzer (VNA). The time signals were synthetically created from the frequency domain S parameter using an inverse Chirp-Z transform approach.

Figure 18:
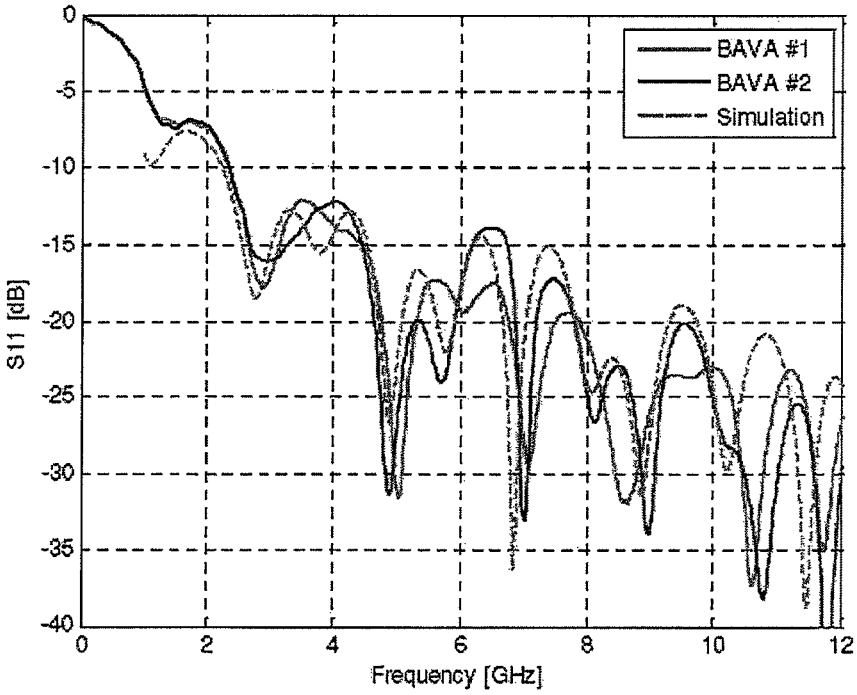
FIG. 18 is a chart of $S_{11}$ versus frequency for various embodiments of a BAVA and a simulation.
Figure 19:
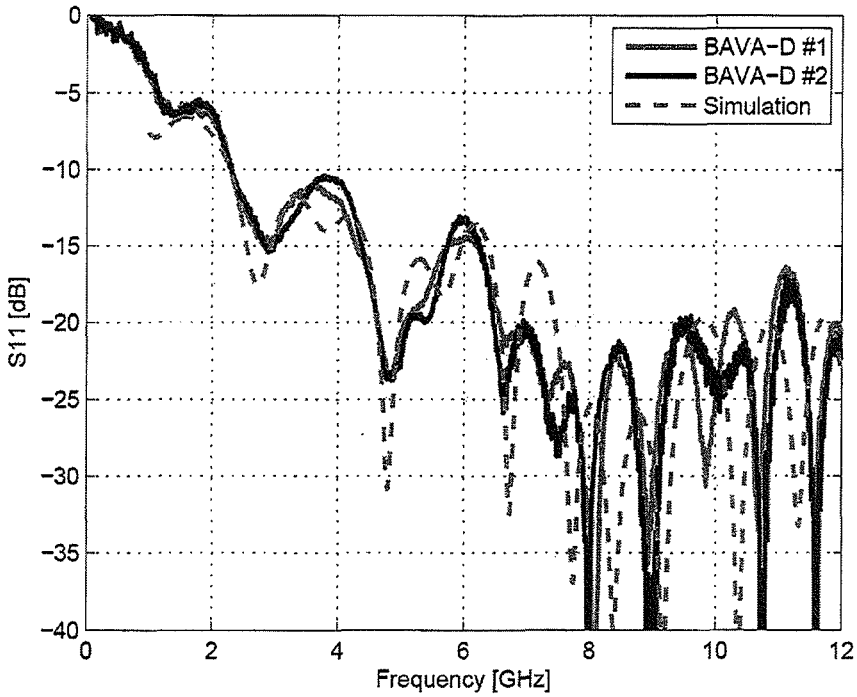
FIG. 19 is a chart of $S_{11}$ versus frequency for various embodiments of a BAVA-D and a simulation.

FIGS. 18 and 19 illustrate that the measured reflection coefficients of two different BAVA and BAVA-D's are within agreement to their corresponding simulated data. One known source of error in the measurements arises from the thermoplastic (Rogers 3001 bonding film) used to bond the different layers together because the adhesive does not match the substrate permittivity exactly. The discrepancy remains acceptable, however, since the bandwidth is not altered to an appreciable extent.

Figure 20:
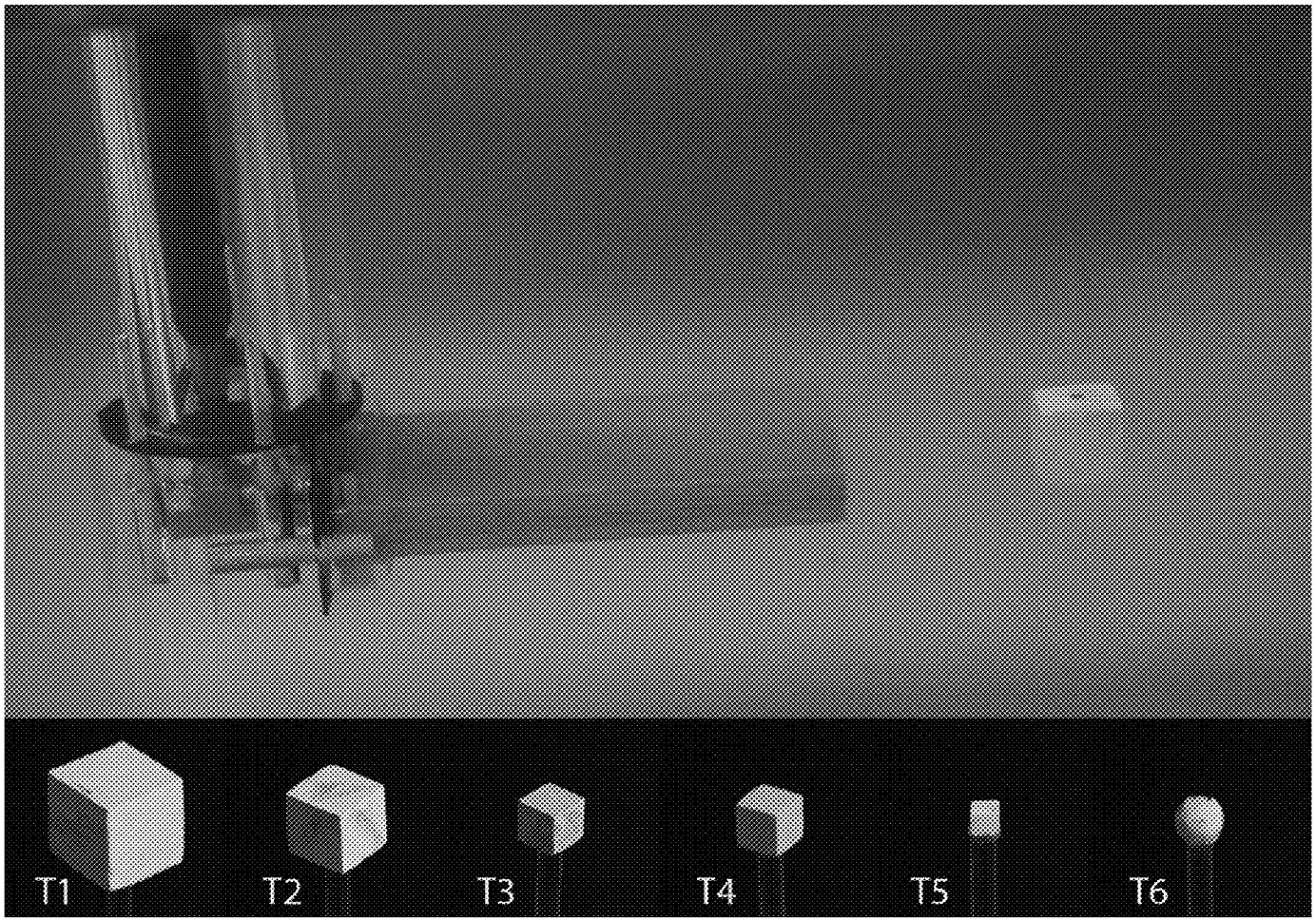
FIG. 20 is an illustration of various objects that can be used to test BAVA operability.

Referring now to FIG. 20, one way to measure and verify the improved directionality in the BAVA-D radiation pattern is to measure the reflections from an object placed in front of the antenna aperture and compare the results with simulations. In one approach, small cubes and spheres of different shape and permittivity can be used (FIG. 20).

In a general approach, the shape of the backscatter signal can be first compared between two simulations performed with a BAVA and BAVA-D illuminating an object with the same size and properties. Then the intensity of the backscatter energy received can be compared between the two antenna versions, and finally a similar object can be measured at various locations along the projected radiation path to assess the directivity of the antennas.

In one approach, such a measurement setup can include of a tank of canola oil that accommodates placement of the antenna and the object (which can be attached to a Plexiglas rod ($\in_r$=2.6)). A reference measurement of the antenna with only the Plexiglas rod present can be subtracted from each measurement taken with the object so as to obtain a measurement of the object exclusively.

Figure 21:
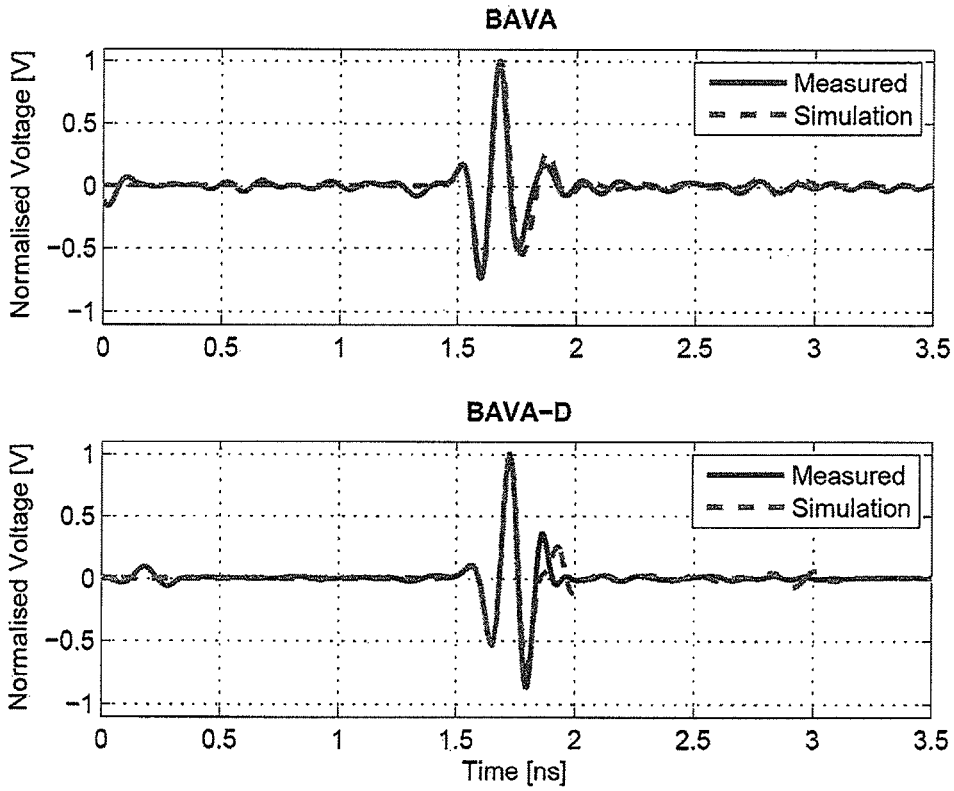
FIG. 21 includes charts of normalized voltage versus time for a simulation, and signals obtained using one embodiment each of a BAVA and a BAVA-D to illuminate the same test object.

Referring to FIG. 21, overall the shapes of the measured backscatter signals are very consistent with their simulated counterpart for both the BAVA and BAVA-D. Concerning the main reflection between 1.5 and 2 ns, it can be observed that the signals overlap almost perfectly for the first part while discrepancies appear in the second part (after t=1.8 ns) (referred to as the "late time response"). This discrepancy can be more accentuated for the BAVA-D yet still provides acceptable results.

Figure 22:
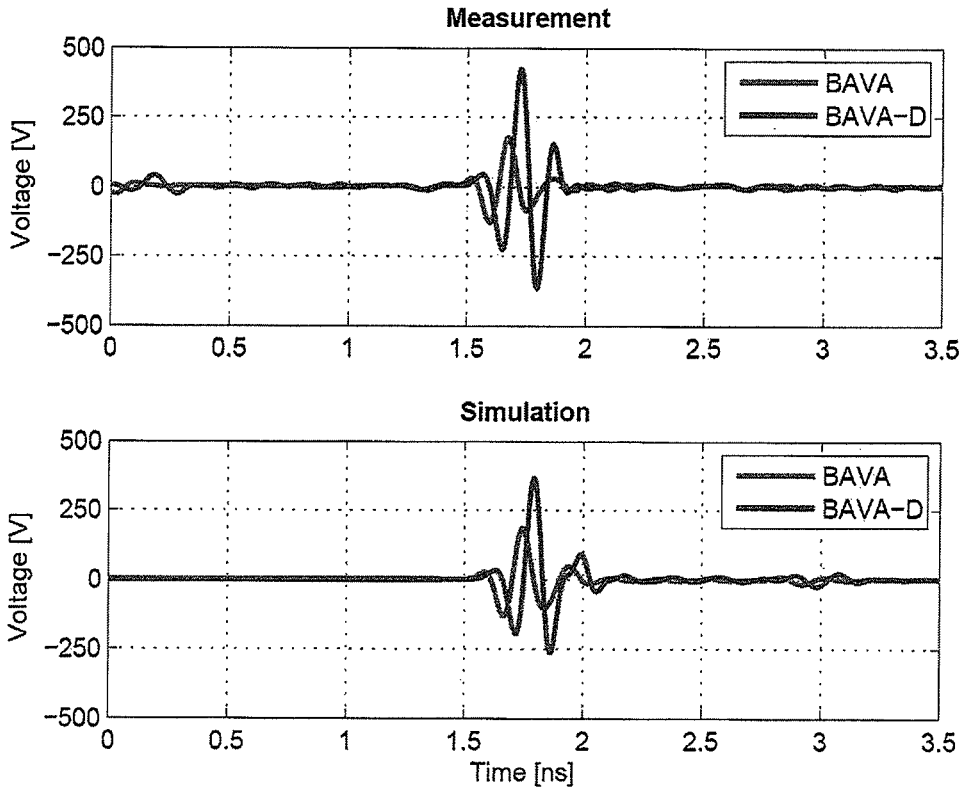
FIG. 22 includes charts of voltage versus time for measured and simulated results of a system incorporating one embodiment each of a BAVA and a BAVA-D when the same test object is illuminated.

The simulated results obtained for the different objects demonstrate intensity ratios ranging from 2.6 to 3.6. It was observed that smaller objects tend to exhibit larger ratios; without wishing to be bound by theory, differences in reflections resulting from illumination by two different beams are expected to be more pronounced for smaller objects when the objects are placed directly in the line-of-sight of the beam. Additionally, the director has a more significant impact on focusing the energy of higher frequencies which may also contribute to the larger reflections observed from smaller objects. The measurements confirm the increase in reflected energy observed with the director and its dependency on the object size. However the measured reflected energy is increased from 4 to 8 times when the BAVA-D is used to detect the different objects, which is more or less twice as much as in simulation. Referring to FIG. 22, the director significantly magnified the tumor response in simulation and measurement.

Figure 23:
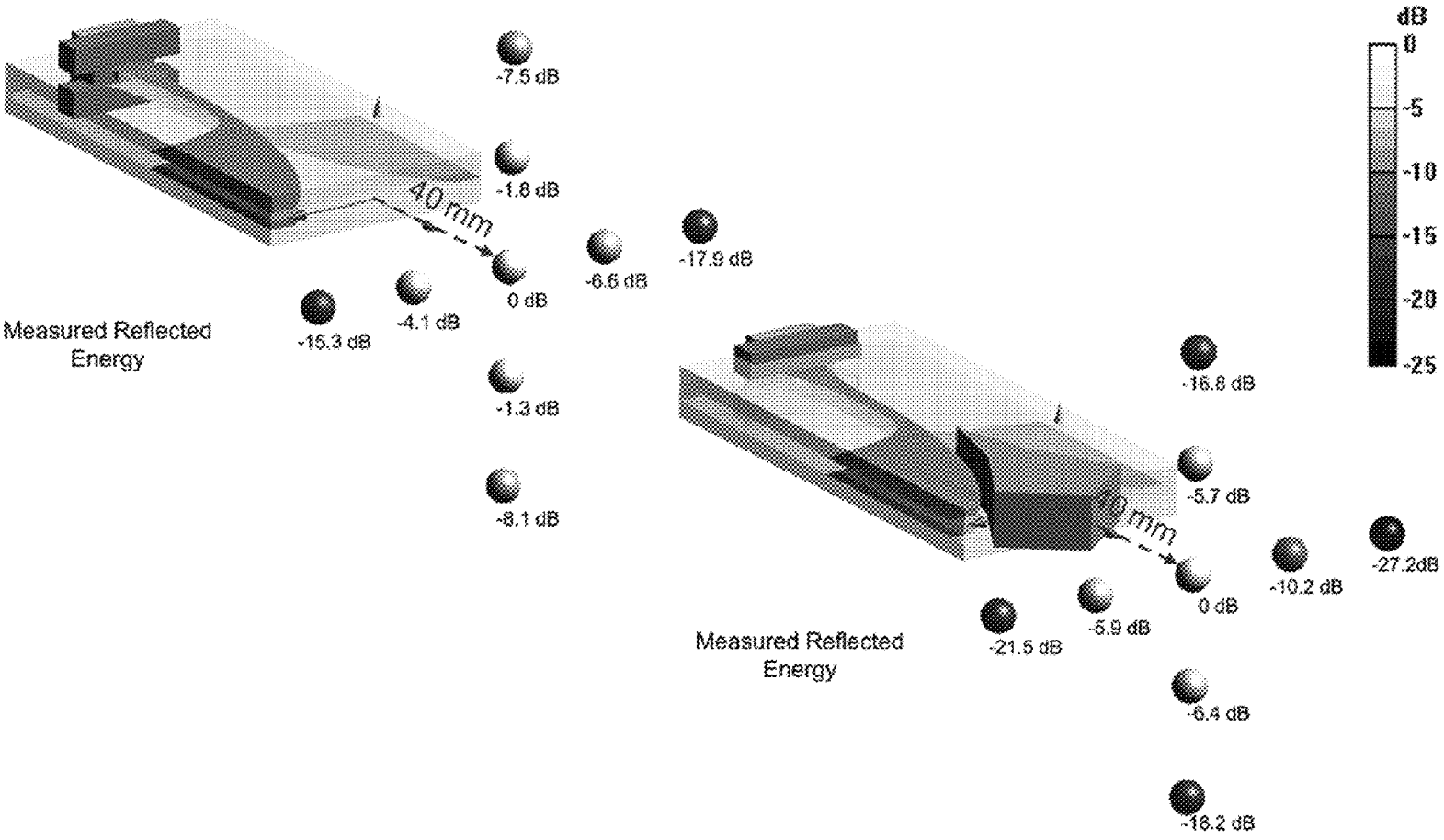
FIG. 23 includes measured reflected energy values of an object at various locations using one embodiment each of a BAVA and a BAVA-D.

In another approach to comparing BAVA and BAVA-D data, a spherical object was used. The experimental procedure included measuring backscatter energy from an object at different locations on a common plane. Measurements were taken on an X plane 40 mm away and at 5 different positions along the Y and Z axis spaced by 20 mm. The backscatter energies were normalized to the central measurement point and converted to dB. Referring now to FIG. 23, a narrowing of the beamwidth, presumably resultant from the director, is most noticeable along the Y axis where the furthest measurement points (y=40 and y=−40 mm) indicate a backscatter energy of approximately −8 dB with the BAVA and approximately −18 dB with the BAVA-D. The backscatter energies are larger toward the positive Z direction which seems to confirm the beam deviation and its orientation observed in simulation.

BAVA and BAVA-D for use in Breast Tumor Detection

A BAVA and/or a BAVA-D may be used in systems configured to detect objects beneath a surface, e.g., tumors located within biological tissue. One implementation of a BAVA or BAVA-D has been mentioned herein with respect to the TSAR system. In some cases, it can be advantageous to conduct computer simulations to assess the functionality of a BAVA or BAVA-D for this particular application.

Figure 24:
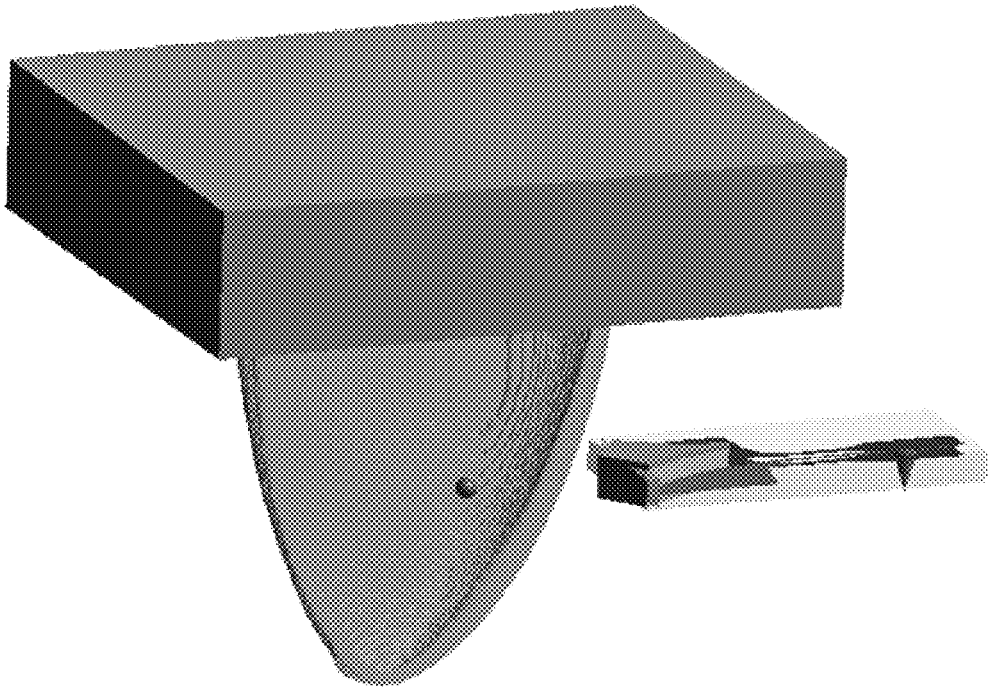
FIG. 24 is an illustration of a breast model, according to one embodiment.

In one simulation approach, a realistic breast model, derived from a MRI scan, can be imported into, e.g., SEMCAD X. A 40 mm thick object representing an artificial chest wall can be added to the upper part of the breast model to simulate the human breast anatomy. Referring now to FIG. 24, the inside of the breast is homogeneous and simulated as adipose tissue with a 6 mm tumor aligned with the antenna. Breast tissue at microwave frequencies is dispersive and modeled in SEMCAD X using single pole Debye models. The Debye parameters are used for the adipose tissue and tumor are found in a reference paper (Lazebnik et al., "Highly Accurate Debye Models for Normal and Malignant Breast Tissue Dielectric Properties at Microwave Frequencies," IEEE_J_MWCL, Vol. 17, pp. 822-824, 2007) while data from a second paper were used to simulate dry skin (Winters et al., "Estimation of the Frequency-Dependent Average Dielectric Properties of Breast Tissue Using a Time-Domain Inverse Scattering Technique," IEEE_J_AP, Vol. 54, pp. 3517-3528, 2006). The chest wall, with a relative permittivity of 50 and electrical conductivity of 4 S/m, is not modeled as a dispersive material. The parameters for the different Debye models are shown in Table 3.

TABLE 3

Debye parameters used to model the properties of different breast tissues.

| Parameter | Dry skin | Adipose tissue (group 3) | Tumor | Unit |
|---|---|---|---|---|
| Epsilon static | 37 | 4.74 | 54.66 | |
| Epsilon infinity | 4 | 3.14 | 6.75 | |
| Dispersive conductivity | 1.1 | 0.036 | 0.79 | S/m |
| Pole amplitude | 1 | 1 | 1 | |
| Pole relaxation time | 7.23 | 13.56 | 10.1 | ps |

Figure 25:
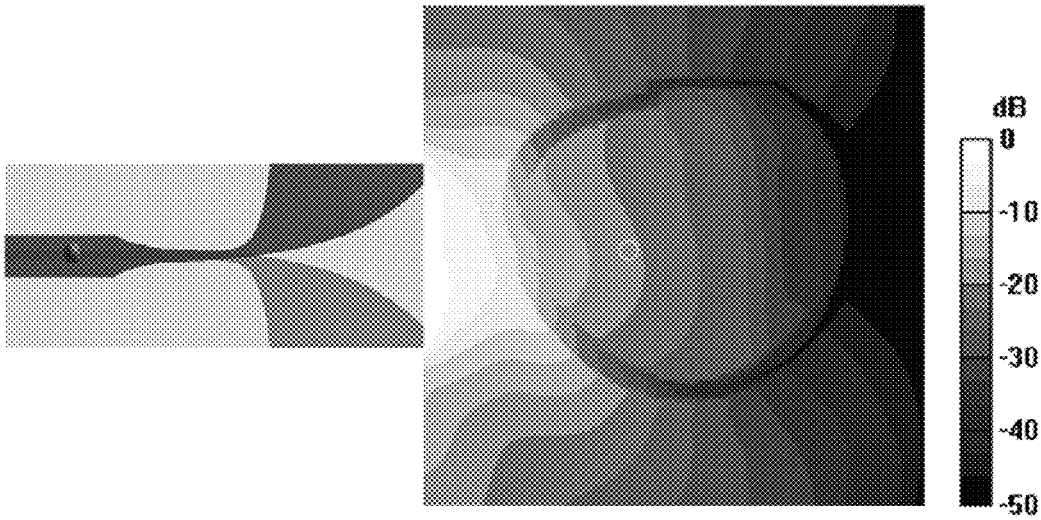
FIGS. 25A and 25B show the energy flux density induced by one embodiment each of a BAVA (a) and a BAVA-D (b) and according to the model shown in FIG. 24
Figure 25:
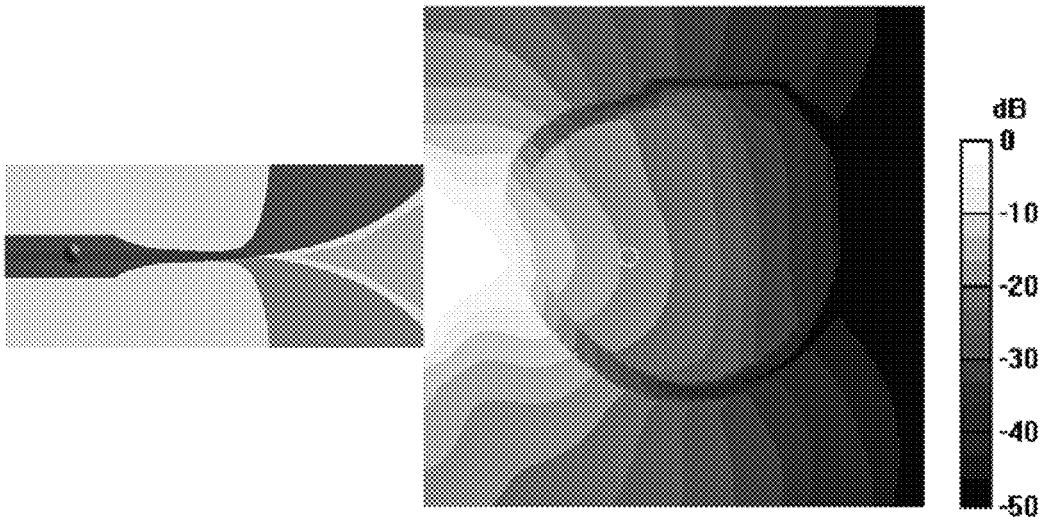
Figure 26:
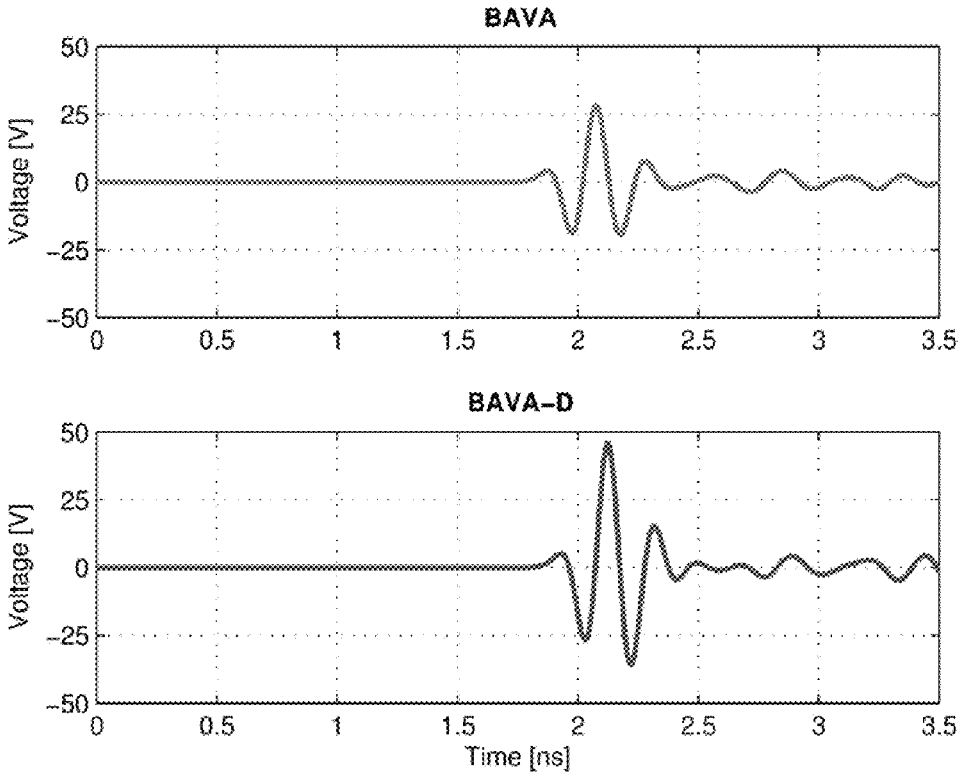
FIG. 26 is a chart of voltage versus time for a simulated tumor, obtained by one embodiment each of a BAVA and a BAVA-D.

The simulations are performed with and without the tumor present so that the tumor reflection could be extracted from the overall signal by a simple subtraction. Additionally, Y and Z Plane sensors are placed in front of the antenna to assess field penetration into the simulated breast. FIG. 25 shows the EFD induced by both antennas on these planes and indicates that more energy is penetrating into the breast when the director is used. This observation is corroborated by the recorded tumor signals shown in FIG. 26. The energy contained in the main tumor reflection (i.e. without the tail) is 2.6 times larger with the BAVA-D compared to the BAVA. The director may therefore dramatically improve tumor sensing when utilizing a BAVA.

Cassiopeia Antenna with Shaped Director Element

Figure 31:
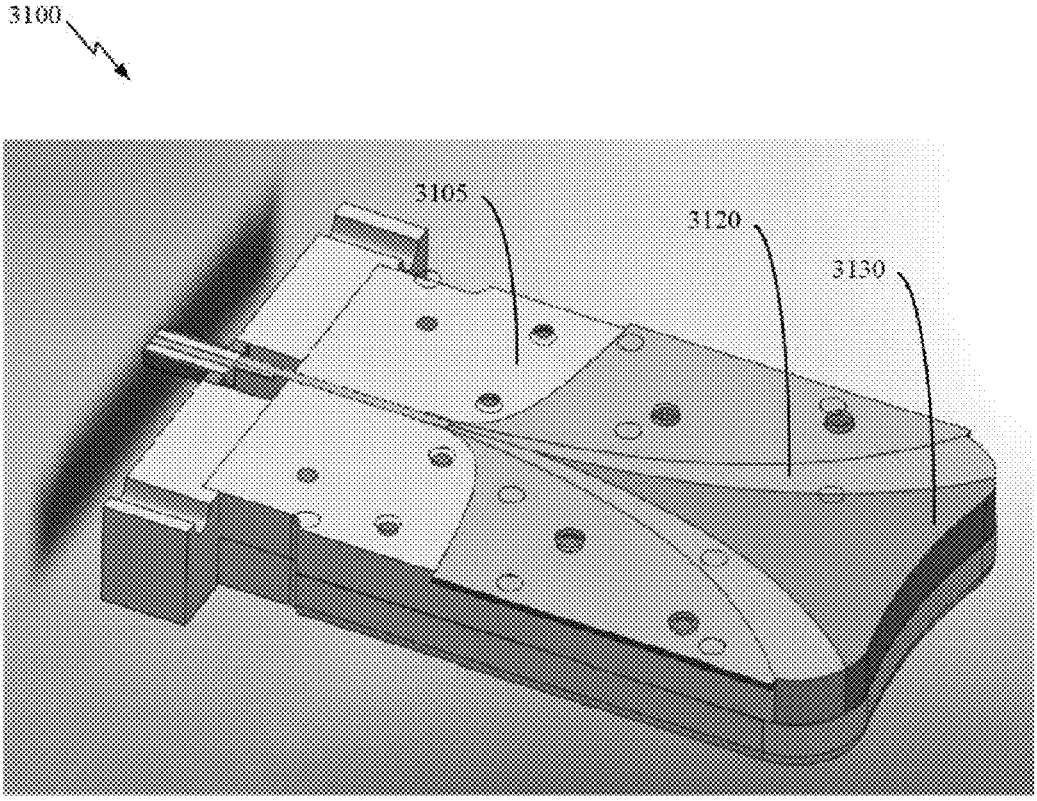
FIG. 31 is a block diagram illustrating a Cassiopeia antenna according to one embodiment.

According to one embodiment, a variation of a tapered slot antenna including a director is a Cassiopeia antenna and illustrated in FIG. 31. A Cassiopeia antenna 3100 has nearly constant radiation performance independent of the surrounding environment. That is, similar performance is achieved by the Cassiopeia antenna 3100 with different dielectric properties in the environment surrounding the Cassiopeia antenna 3100. A material 3105 includes low permittivity material and isolates the antenna structure from potential conductive environments surrounding the Cassiopeia antenna 3100. The material 3105 may be, for example, Delrin, which has a relative permittivity of approximately 3. The Cassiopeia antenna 3100 also includes an aperture 3120 having a director 3130 inside the aperture 3120. According to one embodiment, material in the director 3130 is of higher permittivity than the aperture 3120. For example, the aperture 3120 may be Eccostock Cement with a permittivity of approximately 10, and the director 3130 may be Eccostock HiK with a permittivity of approximately 12. The relatively high permittivities of the aperture 3120 and the director 3130 concentrate electromagnetic energy inside of the Cassiopeia antenna 3100.

Figure 32:
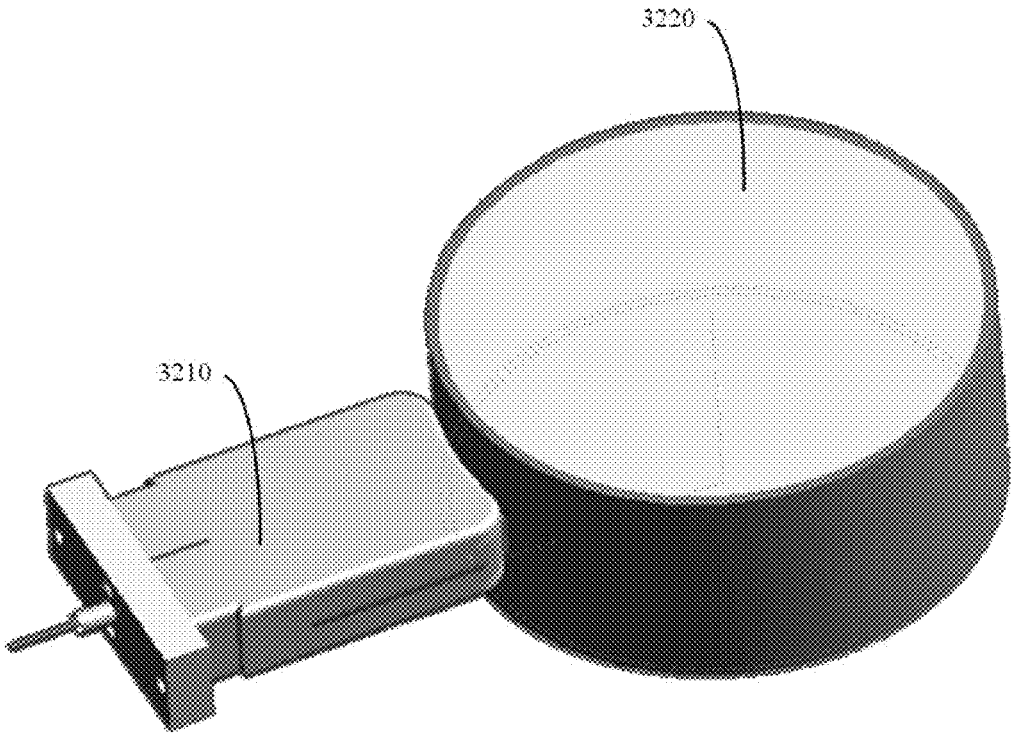
FIG. 32 is a block diagram illustrating a Cassiopeia antenna placed in front of a breast model according to one embodiment.

The director 3130 may be shaped to approximately conform to contours of a surface the object of interest for measurement. For example, a Cassiopeia antenna 3210 for illuminating a breast according to one embodiment is illustrated in FIG. 32. A Cassiopeia antenna 3210 may include a director shaped to conform to a surface of a breast model 3220 or of a human breast (not shown). Contact between the breast model 3220 and the Cassiopeia antenna 3210 during illumination and measurement may confine electromagnetic energy and substantially prevent deterioration in electromagnetic energy caused by changes in a surrounding environment.

Figure 33:
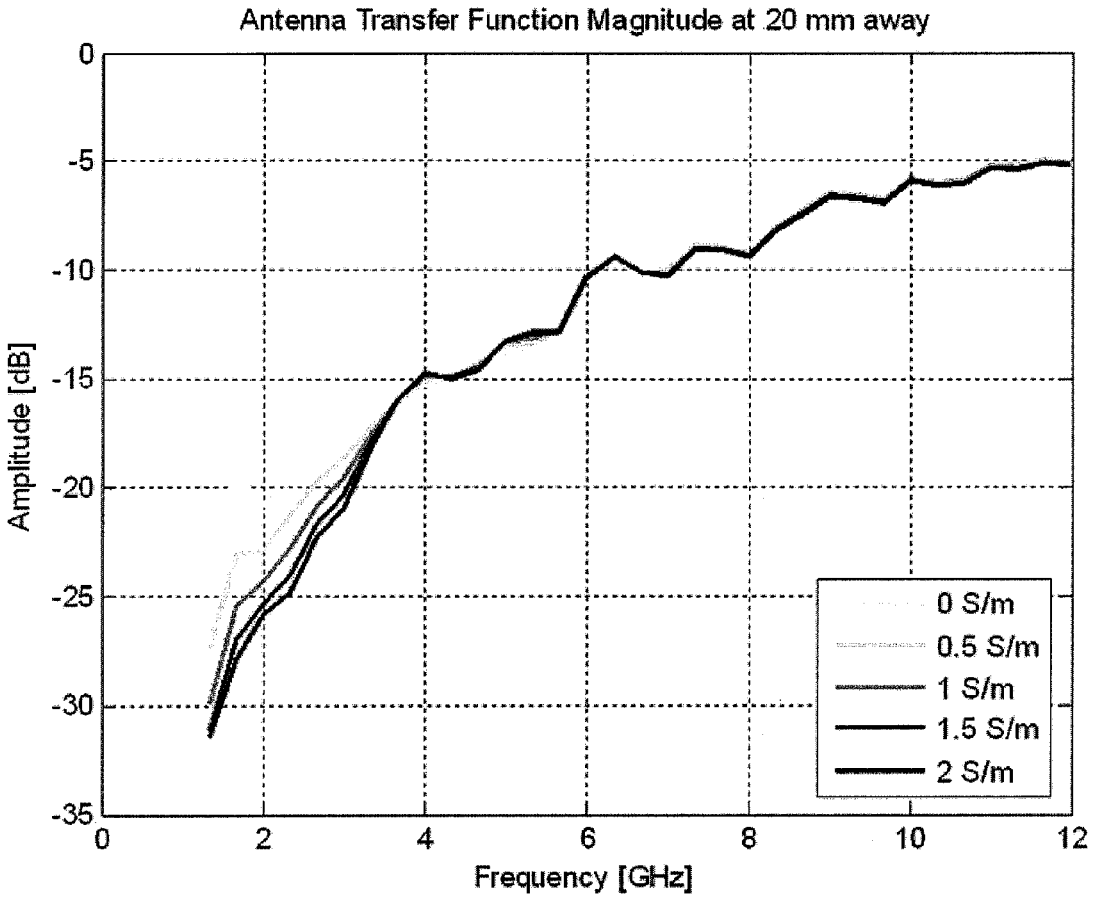
FIG. 33 is a graph illustrating the Transmitting Antenna Transfer Function (TATF) variation of the Cassiopeia antenna for various liquid conductivities.
Figure 34:
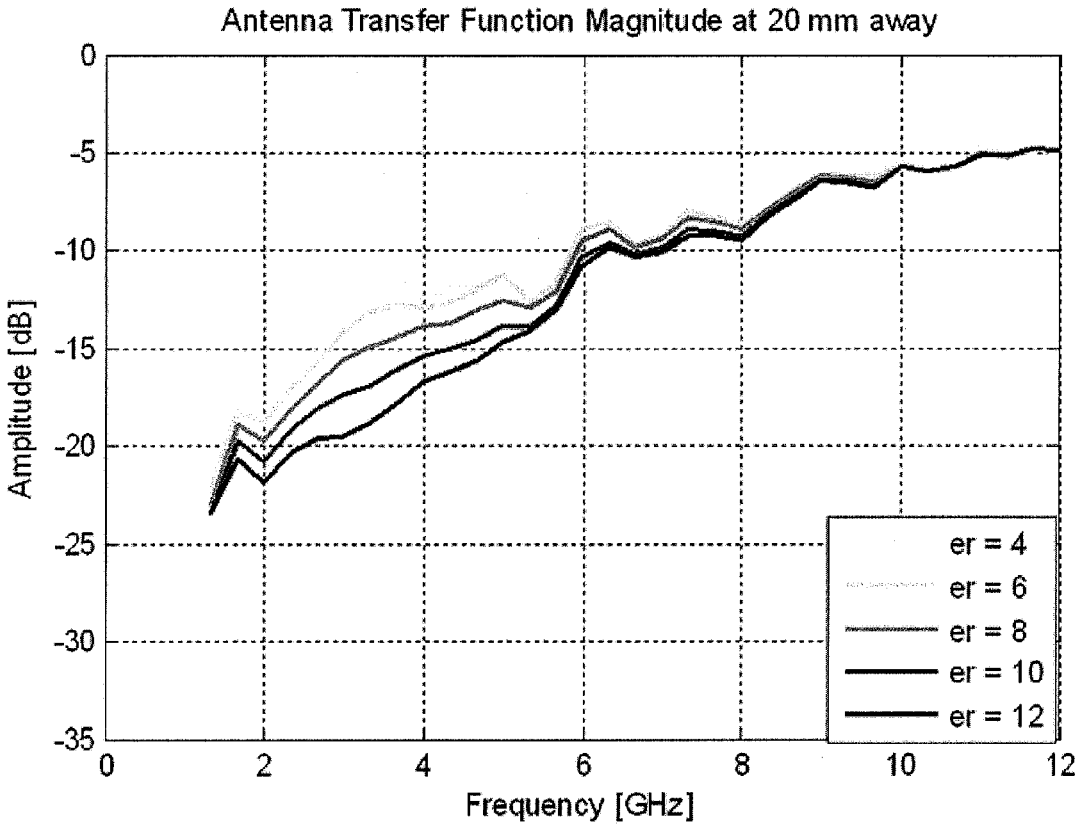
FIG. 34 is a graph illustrating the Transmitting Antenna Transfer Function (TATF) variation of the Cassiopeia antenna for various liquid permittivity.

FIGS. 33 and 34 are graphs demonstrating simulated Transmitting Antenna Transfer Functions (TATFs) for the Cassiopeia antenna. The TAFT is a ratio of the power density of the radiated field at a selected position to the excitation power of the antenna. The breast model used for simulation of FIGS. 33 and 34 is a 12 cm diameter cylinder enclosed in a 2 mm layer of skin. The simulated relative permittivity of skin is 36 and of fat is 9. The simulated conductivity of skin is 4 S/m and of fat is 0.9 S/m. FIGS. 33 and 34 are graphs illustrating simulated TATF for different conductivities and permittivities, respectively, for an observation point immediately in front of the Cassiopeia antenna and 20 mm inside the cylindrical breast model.

Figure 27:
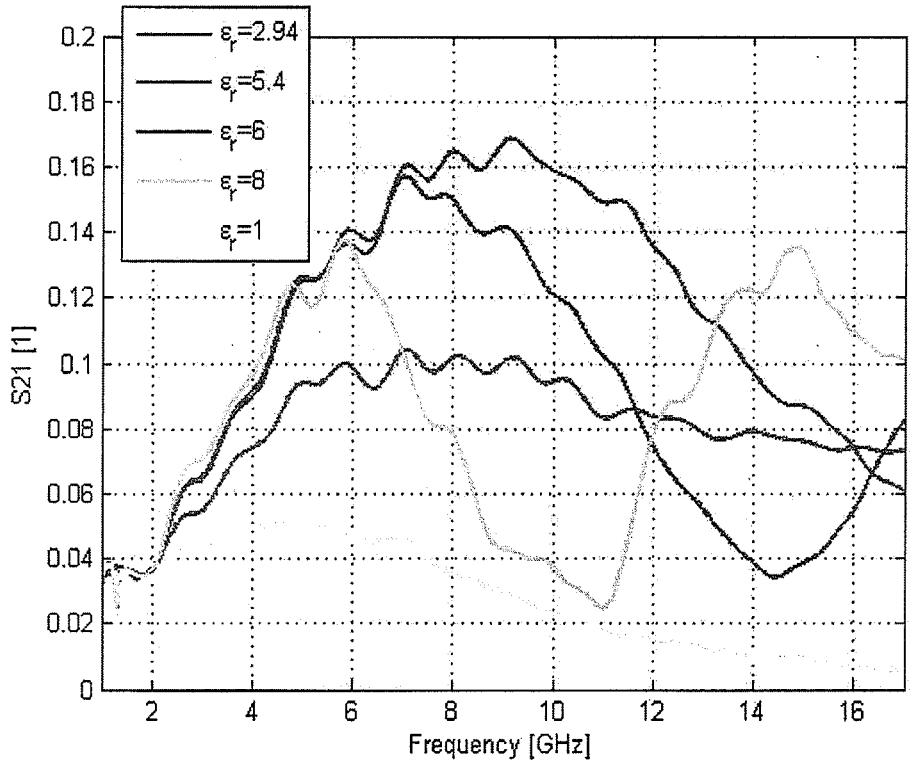
FIG. 27 shows the effect of a director with different permittivity value on the transmission parameter $S_{21}$ obtained with two embodiments of a BAVA-D, separated by 100 mm and facing each other.
Figure 28:
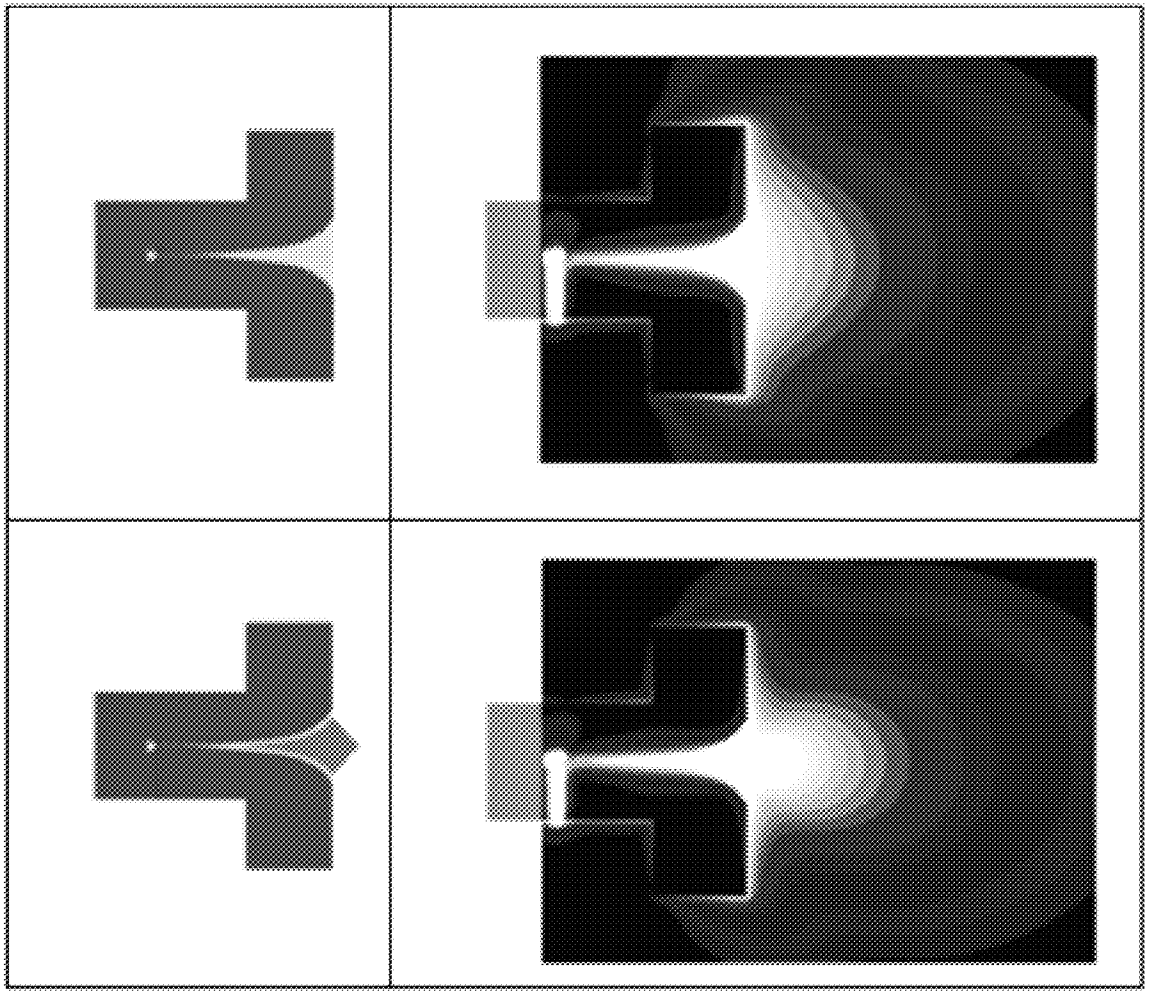
FIG. 28 presents the application of a director to a tapered slot antenna.
Figure 29:
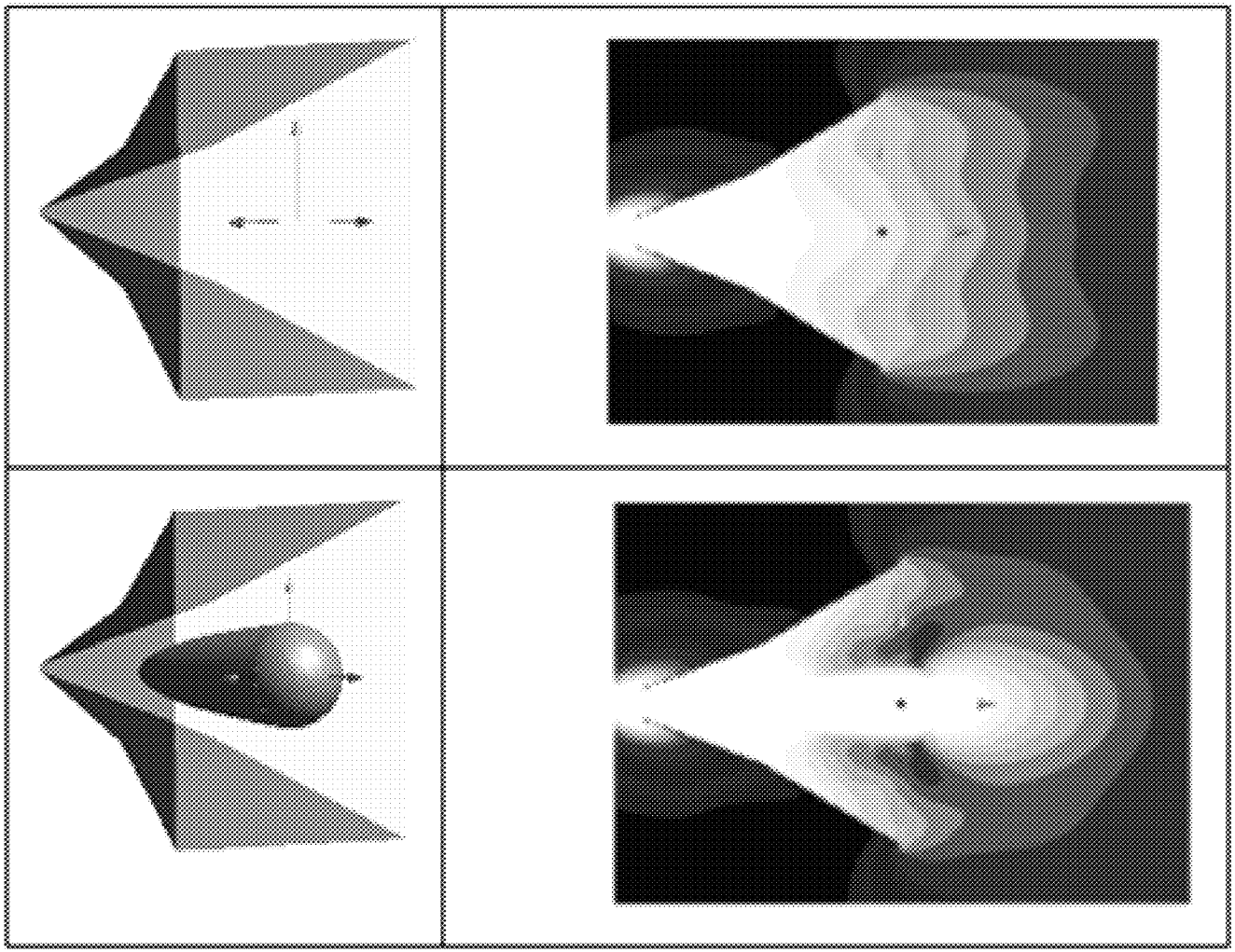
FIG. 29 presents the application of a director to a TEM horn antenna.

It is to be understood that while certain concepts have been described in conjunction with the detailed description thereof, the foregoing description is intended to illustrate and not limit the scope of this disclosure, which is defined by the scope of the appended claims. For example, while the discussion above has been mainly presented with reference to BAVA antennas, the disclosed addition of a director may be reasonably expected to perform advantageously in any travelling wave antenna or any other applications necessitating transmission or reception of a short pulse with a narrow beamwidth. Other shapes and permittivity values for the director than those disclosed herein have the potential to produce similar or better results. Referring to FIG. 27, $S_{21}$ parameters for BAVAs with varying director permittivities are contemplated. It can be observed that a director with different permittivity can improve or degrade the performances at certain frequencies. Referring now to FIGS. 28 and 29, different director shapes can be used for different types of endfire aperture-based traveling-wave antennas, for example, a tapered slot antenna (FIG. 28) and a TEM horn (FIG. 29). In both cases there is a higher concentration of radiated energy in the endfire direction when the director is present.

Computational techniques and software packages other than those disclosed herein, yet known to those skilled in the art can be used to determine and model the radiation pattern in the near field. For example, options available in SEMCAD X, can create highly realistic simulations. Other aspects, advantages, and modifications are within the scope of the following claims.

What is claimed is:

1. An endfire aperture-based traveling-wave antenna comprising:

a plurality of conductors separated by a dielectric material and coupled to an antenna feed structure to cooperatively transmit and receive electromagnetic radiation, the plurality of conductors including at least a first flared conductor that flares outwardly from a longitudinal axis and a second flared conductor that flares outwardly from the longitudinal axis in an orientation opposite from the first flared conductor so as to at least partially define an aperture region therebetween; and a dielectric director arranged in the aperture region between the first flared conductor and the second flared conductor to provide a concentrated radiation pattern when transmitting the electromagnetic radiation;

wherein the dielectric director comprises a material having a dielectric permittivity higher than the dielectric material that separates the conductors.

2. The antenna of claim 1, wherein the first flared conductor and the second flared conductor are at least partially defined by an aperture curve and a flare curve.

3. The antenna of claim 1, wherein the first and second conductors curve outwardly away from the longitudinal axis so as to exhibit separation variations along a length of the first and second conductors.

4. The antenna of claim 1, wherein the plurality of conductors comprises a third flared conductor that curves outwardly from the longitudinal axis in an orientation opposite the first flared conductor.

5. The antenna of claim 4, wherein the first flared conductor comprises a central conductor and the second and third conductors comprise ground conductors.

6. The antenna of claim 5, wherein the first conductor is separated from the second conductor by a first substrate layer of dielectric material and the first conductor is separated from the third conductor by a second substrate layer of dielectric material.

7. The antenna of claim 1, wherein the dielectric director comprises several materials, each material having a dielectric permittivity higher than the dielectric material that separates the conductors.

8. The antenna of claim 1, wherein the director is shaped to substantially conform to a surface of an object for illumination.

9. A Vivaldi antenna, comprising:

ground and conductor electrodes each having a flared contour and configured to cooperatively emit radiation in a selected propagation direction, said ground and conductor electrodes being separated by one or more dielectric substrates; and a dielectric director configured to at least partially focus said radiation in said selected propagation direction, arranged at least partially between said ground and conductor electrodes.

10. The Vivaldi antenna of claim 9, wherein said Vivaldi antenna is an antipodal Vivaldi antenna.

11. The antipodal Vivaldi antenna of claim 10, wherein said antipodal Vivaldi antenna is a balanced antipodal Vivaldi antenna.

12. The Vivaldi antenna of claim 9 wherein said radiation is broadband radiation.

13. The Vivaldi antenna of claim 12, wherein said broadband radiation is within a frequency range of about 2 to 18 GHz.

14. The Vivaldi antenna of claim 9, wherein said dielectric director has a dielectric permittivity higher than said dielectric substrate.

15. The Vivaldi antenna of claim 9, wherein said configuration to at least partially focus said radiation in said selected propagation direction comprises said dielectric director having dielectric permittivities and a shape that affects propagation of an electromagnetic pulse or wave traveling along said ground and conductor electrodes in a determinable manner.

16. The Vivaldi antenna of claim 9, wherein said antenna is immersible in an immersion medium.

17. The Vivaldi antenna of claim 16, wherein said immersion medium is oil.

18. The Vivaldi antenna of claim 17, wherein said oil is canola oil.

19. A method for detecting objects beneath or disposed in biological tissue, comprising:

providing a Vivaldi antenna configured for use in a tissue sensing adaptive radar (TSAR) system; and using the TSAR system to detect an object beneath or disposed in said biological tissue;

wherein the Vivaldi antenna comprises:

ground and conductor electrodes each having a flared contour and configured to cooperatively emit radiation in a selected propagation direction, said ground and conductor electrodes being separated by one or more dielectric substrates; and a dielectric director configured to at least partially focus said radiation in said selected propagation direction, arranged at least partially between said ground and conductor electrodes.

20. The method of claim 19, wherein using the TSAR system comprises contacting the Vivaldi antenna to a breast.

21. An antenna, comprising:

a plurality of planar ground conductors each having a feeding line ground plane;

a planar conductor electrode having a signal conductor on a feeding line;

a connector for connecting said ground conductors and said conductor electrode to an external assembly capable of transmitting or receiving electromagnetic energy; and a director, disposed in an area between where a first ground conductor and a first conductor electrode curve away from one another;

wherein said planar ground conductors and said planar conductor electrode are separated by one or more dielectric substrates; and wherein said director is formed of a material having a dielectric permittivity that is higher than a dielectric permittivity of said one or more dielectric substrates.

* * * * *